US011787603B2

(12) United States Patent
Batzel et al.

(10) Patent No.: US 11,787,603 B2
(45) Date of Patent: Oct. 17, 2023

(54) SLIDING CLOSURE AND CONTAINER

(71) Applicant: RB INNOVATIONS, LLC, Moscow, PA (US)

(72) Inventors: Zachary (Rocky) Batzel, Moscow, PA (US); Daniel A. Batzel, Jessup, PA (US)

(73) Assignee: RB INNOVATIONS, LLC, Moscow, PA (US)

( * ) Notice: Subject to any disclaimer, the term of this patent is extended or adjusted under 35 U.S.C. 154(b) by 0 days.

(21) Appl. No.: 17/254,535

(22) PCT Filed: Jun. 28, 2019

(86) PCT No.: PCT/US2019/039742
§ 371 (c)(1),
(2) Date: Dec. 21, 2020

(87) PCT Pub. No.: WO2020/006364
PCT Pub. Date: Jan. 2, 2020

(65) Prior Publication Data

US 2021/0269201 A1 Sep. 2, 2021

Related U.S. Application Data

(60) Provisional application No. 62/692,151, filed on Jun. 29, 2018.

(51) Int. Cl.

| | |
|---|---|
| ***B65D 43/20*** | (2006.01) |
| ***B65D 50/04*** | (2006.01) |
| ***A61J 1/03*** | (2023.01) |

(52) U.S. Cl.
CPC ..... *B65D 43/20* (2013.01); *A61J 1/03* (2013.01); *B65D 50/046* (2013.01); *B65D 2215/02* (2013.01)

(58) Field of Classification Search
CPC .. B65D 43/20; B65D 50/046; B65D 2215/02; B65D 5/646; B65D 43/12; B65D 50/04; B65D 11/12; B65D 50/045; B65D 5/38; B65D 47/286; A61J 1/03; A61J 1/00
USPC ..... 220/345.2–345.4, 300, 345.1–345.4, 220/254.9, 315, 351; 206/38, 96, 1.5, 206/468; 215/201, 301, 245, 322
See application file for complete search history.

(56) References Cited

U.S. PATENT DOCUMENTS 2,273,999 A 2/1942 Rueger
2,492,846 A 12/1949 Coyle et al.
(Continued)

FOREIGN PATENT DOCUMENTS

WO WO-2004089169 A2 * 10/2004 ..... A47G 19/2272

*Primary Examiner* — John K Fristoe, Jr.
*Assistant Examiner* — John Martin Hoppmann
(74) *Attorney, Agent, or Firm* — OLSON & CEPURITIS, LTD.

(57) ABSTRACT

Novel lockable safety closures and containers comprising the closures are described herein. The containers and closures are useful for dispensing valuable, dangerous, or potentially dangerous goods, and are easy for adults (including the elderly or frail) to open, but difficult for children to open. The closures include a displaceable slider covering a main opening for accessing the interior of a container. The slide includes one or more depressible tabs that keep to slider in a closed, and which can be opening by depressing the tab (or tabs) and urging the slider to an open position.

9 Claims, 18 Drawing Sheets

(56) References Cited

U.S. PATENT DOCUMENTS

| | | | | |
|---|---|---|---|---|
| 3,240,373 | A | 3/1966 | Dulle | |
| 3,720,346 | A | 3/1973 | Cypher | |
| 3,888,350 | A * | 6/1975 | Horvath | B65D 50/045 220/345.3 |
| 3,924,768 | A | 12/1975 | Lemons | |
| 3,949,899 | A | 4/1976 | Jacobs et al. | |
| 4,192,422 | A * | 3/1980 | Kotyuk | B65D 83/0445 220/345.3 |
| 4,819,829 | A * | 4/1989 | Rosten | B65D 5/727 220/345.3 |
| 4,832,221 | A | 5/1989 | Manem | |
| 5,058,775 | A | 10/1991 | Gross et al. | |
| 5,082,137 | A | 1/1992 | Weinstein | |
| 5,400,914 | A | 3/1995 | Lin | |
| 6,510,960 | B1 | 1/2003 | Christopherson et al. | |
| 7,114,619 | B2 | 10/2006 | Ellis et al. | |
| 7,178,674 | B2 | 2/2007 | Krumme | |
| 7,275,653 | B2 | 10/2007 | Tedford, Jr. | |
| 7,481,339 | B1 | 1/2009 | Hsu | |
| 7,594,588 | B2 | 9/2009 | Auer | |
| 7,748,554 | B2 | 7/2010 | Murphy | |
| 8,657,136 | B2 | 2/2014 | Adler et al. | |
| 8,931,657 | B2 | 1/2015 | Kientzle et al. | |
| 9,365,333 | B2 | 6/2016 | Batzel et al. | |
| 9,919,837 | B2 | 3/2018 | Batzel et al. | |
| 2009/0152134 | A1 * | 6/2009 | Katsis | B65D 5/38 206/96 |
| 2010/0276461 | A1 | 11/2010 | Stevens | |
| 2011/0226772 | A1 * | 9/2011 | Adler | B65D 50/046 220/315 |
| 2013/0153575 | A1 * | 6/2013 | Clodfelter | B65D 47/0857 220/265 |
| 2016/0297580 | A1 * | 10/2016 | Batzel | B65D 21/0204 |

* cited by examiner

SLIDING CLOSURE AND CONTAINER

CROSS-REFERENCE TO RELATED APPLICATIONS

This application is a 371 of PCT/US2019/39742, filed on Jun. 28, 2019, which claims the benefit of U.S. Provisional Application Ser. No. 62/692,151, filed on Jun. 29, 2018, each of which is incorporated herein by reference in its entirety.

FIELD OF THE INVENTION

This invention pertains to sliding closures for containers. More particularly, this invention relates to caps and containers with sliding closure features.

BACKGROUND

Currently most medications and hazardous or harmful consumer goods (e.g., cleaning agents, pesticides, etc.) are distributed in containers that use a safety closure (often referred to as a "child-resistant closure" or a "child-resistant cap") with some sort of a push and turn mechanism to unlock the closure for access to the container contents. Given the number of children who fatality ingest or are seriously injured by medications or hazardous consumer goods, the child-resistant feature is a mandatory component in many jurisdictions for all over-the-counter (OTC) and prescription drugs, for example. However, such push and turn mechanisms can be difficult for individuals with limited dexterity (specifically the elderly) to open. In addition, there are many other negative attributes to standard packaging systems. U.S. Pat. No. 9,365,333 to Batzel et al. and U.S. Pat. No. 9,919,837 to Batzel, collectively referred to herein as the "Batzel patents", which are incorporated herein by reference in their entireties, disclose certain push and slide type safety closures, however, there is an ongoing need for improved or alternative sliding closure designs. The closures described herein address this need.

SUMMARY

Novel, lockable closures, and containers comprising the closures, are described herein. The containers and closures described herein can be used in conjunction with any desired content (liquid or solid). Typically, the containers and closures are useful for dispensing valuable, dangerous, or potentially dangerous goods, and are easy for adults (including the elderly or frail) to open, but physically or intellectually difficult for children to open (i.e., child-resistant); however, the sliders can be designed to be relatively easily opened by anyone (non-child-resistant), if desired. The closures include a displaceable slider covering a main opening of the container for accessing the interior of a container body to which the closure is mounted. The slider includes one or more depressible tabs that help keep the slider stayed over the main opening of the container. Access to the interior is achieved by depressing the tab (or tabs) and displacing the slider.

The container embodiments disclosed herein include polyhedral container forms (square, rectangular, pentagonal, etc., in cross section), generally referred to as "cuboidal" herein or, as applicable, "truncated cuboidal", but can be implemented in other container forms, e.g. classic round (i.e., cylindrical), ellipsoidal or even spherical containers.

The closures comprise a closure body (also referred to herein as a "cap") and a sliding closure (a "slider") that is fitted within a groove or track in the closure body. The slider covers the main opening of the closure (and the main opening of the container body, if separate). The slider can be slidingly displaced through an auxiliary opening (also referred to herein as a "slider port") in the closure body to uncover the main opening. In some embodiments, the closure body is an integrated part or portion of the container body. In other embodiments, the closure body is a separate piece that is mated, either permanently or removeably, with a container body over the main opening thereof. The slider includes a depressible tab (e.g., one or more tabs) that engage with or are blocked by a framing structure around the slider port. The slider is mounted in the closure body in a track (e.g., a groove or spaced pairs of bars or rails) that allows slideable displacement of the slider within the track.

The tab or tabs can be depressed by modest pressure (e.g., from a finger or thumb of an adult), so that the tab is no longer blocked by the framing structure and the slider can then be slid through the slider port while holding down the tab. The tab is biased to that it will rebound when the pressure is released. Retaining buttons or stops preferably are included on the slider to prevent the slider from being inadvertently completely removed from the closure body. The stops are constructed and arranged to control how far the slider will be displaced under normal usage and to allow removal of the slider when desired. Locks, safety seals, and other anti-tamper or child-resistant features also can be included on the closures and containers described herein. The closure preferably includes sealing features for forming tight seals between the slider and the main opening of the closure. The following non-limiting embodiments illustrate certain aspects and features of the containers and closures described herein.

Embodiment 1 comprises a closure for a container that comprises a container body defining an interior chamber, and that defines an aperture open to the interior chamber; the closure comprising:

a closure body defining a fixed main opening and a slider port; wherein the main opening of the closure and the container aperture are aligned to permit access to the interior chamber of the container when the closure body is attached to the container body for use;

a slider mounted in the closure body blocking the main opening in a closed configuration; the slider having an inner surface facing the main opening and an opposite outer surface; wherein the slider is configured to be displaceable in a direction leading through the slider port to clear the main opening, exit the closure body partially or completely in an open configuration, and to be displaceable back to the closed configuration; and at least one resilient depressible tab on the outer surface of the slider; the tab being constructed and arranged so that, when the slider is in the closed configuration, the tab is adjacent to the slider port and prevents the slider from being displaced through the slider port; and depressing the tab enables the slider to be displaced through the slider port to place the slider in the open configuration; wherein the tab comprises a resilient structure selected from the group consisting of:

(a) an arched elongate band fixed at two opposed ends thereof to the outer surface of the slider and positioned on the slider adjacent to the slider port when the slider is in the closed configuration; the band comprising a resilient segment between the two ends thereof oriented parallel to the slider port, the resilient segment being arched away from the outer surface of the slider to a height sufficient to be blocked by a portion of the closure body surrounding the slider port in a released state; and wherein the resilient segment can be depressed to a height sufficient to clear the portion of the closure body surrounding the slider port so that the slider can be displaced through the slider port; and the resilient segment rebounds to the released state when no longer depressed;

(b) a resilient dome fixed to the outer surface of the slider, the dome having a height that is sufficient to be blocked by a portion of the closure body surrounding the slider port in a released state, and positioned on the slider so that the dome is adjacent to the slider port when the slider is in the closed configuration; and wherein the dome can be depressed to a height sufficient to clear the portion of the closure body surrounding the slider port so that the slider can be displaced through the slider port, and the dome rebounds to the released state when no longer depressed;

(c) an elongate cantilevered band fixed at one end thereof to the outer surface of the slider and having an opposed free end; the cantilevered band being oriented perpendicular to the displacement direction of the slider and positioned on the slider adjacent to the slider port when the slider is in the closed configuration; the free end of the cantilevered band extending over the outer surface of the slider to a height sufficient to be blocked by a portion of the closure body surrounding the slider port in a released state; wherein the free end of the cantilevered band can be depressed to a height sufficient to clear the portion of the closure body surrounding the slider port so that the slider can be displaced through the slider port; and the free end of the cantilevered band rebounds to the released state when no longer depressed;

(d) a spring-biased button fixed to the outer surface of the slider and positioned on the slider adjacent to the slider port when the slider is in the closed configuration; the spring-biased button having a height sufficient to be blocked by a portion of the closure body surrounding the slider port in a released state; and wherein the spring-biased button can be depressed sufficiently to clear the portion of the closure body surrounding the slider port so that the slider can be displaced through the slider port; and the spring-biased button rebounds to the released state when no longer depressed; and (e) an elongate lever fixed at one end thereof to the outer surface of the slider and having an opposed free end; the lever being oriented along the displacement direction of the slider and positioned on the slider with the free end adjacent to, within, or beyond the slider port when the slider is in the closed configuration; the free end of the lever extending over the outer surface of the slider to a height sufficient for a portion of the closure body surrounding the slider port to block or engage with the lever in a released state; wherein the free end of the lever can be depressed to a height sufficient to allow the lever to clear the portion of the closure body surrounding the slider port, so that the slider can be displaced through the slider port; and the free end of the lever rebounds to the released state when no longer depressed; and wherein the lever includes one or more feature selected from the group consisting of a longitudinal split dividing the free end of the lever into two depressible parts, a groove spaced from the free end of the lever that is configured and arranged to receive a portion of the closure body surrounding the slider portal within the groove, and a head portion at the free end of the lever which extends through the slider portal in the closed configuration.

Embodiment 2 comprises the closure of embodiment 1, further comprising at least one raised portion on the outer surface of the slider positioned and configured to allow the slider to be advanced a selected distance through the slider port and having a sufficient height from the outer surface of the slider to be blocked by the portion of the closure body surrounding the slider port and prevent the slider from being wholly removed from the closure body in normal use.

Embodiment 3 comprises the closure of embodiment 2, wherein the height of the raised portion is selectively adjustable to clear the slider port for full removal of the slider from the closure body.

Embodiment 4 comprises the closure of any one of embodiments 1 to 3, wherein the slider includes a plurality of the depressible tabs on the outer surface thereof, and the plurality of depressible tabs are spaced from each other.

Embodiment 5 comprises the closure of any one of embodiments 1 to 4, wherein edges of the slider ride on one or more internal tracks in the closure body.

Embodiment 6 comprises the closure of any one of embodiments 1 to 4, wherein edges of the slider ride in one or more internal grooves in the closure body.

Embodiment 7 comprises the closure of any one of embodiments 1 to 6, wherein the outer surface of the slider comprises two of the elongate cantilevered bands, (c).

Embodiment 8 comprises the closure of embodiment 7, wherein the free ends of the two cantilevered bands face each other.

Embodiment 9 comprises the closure of any one of embodiments 1 to 8, wherein the slider includes a head portion that extends through and beyond the slider port in the closed configuration.

Embodiment 10 comprises the closure of any one of embodiments 1 to 9, further comprising at least one removable locking clip engageable with the slider and closure body to prevent depressing the tab.

Embodiment 11 is a container comprising:

a container body defining an interior chamber, and defining a container aperture open to the interior chamber; and a sliding closure of any one of embodiments 1 to 10 affixed to the container body over the container access.

Embodiment 12 comprises the container of claim 11, wherein the container body defines finger grip sections to accommodate a hand grasping the container.

Embodiment 13 is a container comprising:

a cylindrical container body defining an interior chamber for storing solid articles, fluids or other contents; the container body having two closed, opposed ends and a cylindrical wall between the ends;

an closure body on the cylindrical wall of the container body, the closure body defining a fixed aperture for access to the interior chamber of the container body and defining at least one fixed slider port oriented longitudinally to the cylindrical wall and framed by a portion of the closure body perpendicular to the cylindrical wall;

a curved slider mounted in the closure body blocking the aperture in a closed configuration; the slider having a curvature that conforms to the curvature of the cylindrical wall of the container body, and having an inner surface facing the interior of the chamber and an opposite outer surface; wherein the slider is configured to be displaceable through the fixed slider port in a lateral direction along a curved path conforming to the curvature of the cylindrical wall to clear the aperture and exit the closure body partially or completely in an open configuration, and to be displaceable back to the closed configuration; and at least one resilient depressible tab on the outer surface of the slider; the tab being constructed and arranged so that, when the slider is in the closed configuration, the tab is adjacent to the slider port and a portion of the container body surrounding the slider port blocks the tab and prevents the slider from being displaced through the slider port; and depressing the tab enables the closure to be displaced through the slider port to place the container in the open configuration.

Embodiment 14 comprises the container of embodiment 13, wherein the tab comprises a resilient structure selected from the group consisting of:

(a) an arched elongate band fixed at two opposed ends thereof to the outer surface of the slider and positioned on the slider adjacent to the slider port when the slider is in the closed configuration; the band comprising a resilient segment between the two ends thereof oriented parallel to the slider port, the resilient segment being arched away from the outer surface of the slider to a height sufficient to be blocked by a portion of the closure body surrounding the slider port in a released state; and wherein the resilient segment can be depressed to a height sufficient to clear the portion of the closure body surrounding the slider port so that the slider can be displaced through the slider port; and the resilient segment rebounds to the released state when no longer depressed;

(b) a resilient dome fixed to the outer surface of the slider, the dome having a height that is sufficient to be blocked by a portion of the closure body surrounding the slider port in a released state, and positioned on the slider so that the dome is adjacent to the slider port when the slider is in the closed configuration; and wherein the dome can be depressed to a height sufficient to clear the portion of the closure body surrounding the slider port so that the slider can be displaced through the slider port, and the dome rebounds to the released state when no longer depressed;

(c) an elongate cantilevered band fixed at one end thereof to the outer surface of the slider and having an opposed free end; the cantilevered band being oriented perpendicular to the displacement direction of the slider and positioned on the slider adjacent to the slider port when the slider is in the closed configuration; the free end of the cantilevered band extending over the outer surface of the slider to a height sufficient to be blocked by a portion of the closure body surrounding the slider port in a released state; wherein the free end of the cantilevered band can be depressed to a height sufficient to clear the portion of the closure body surrounding the slider port so that the slider can be displaced through the slider port; and the free end of the cantilevered band rebounds to the released state when no longer depressed;

(d) a spring-biased button fixed to the outer surface of the slider and positioned on the slider adjacent to the slider port when the slider is in the closed configuration; the spring-biased button having a height sufficient to be blocked by a portion of the closure body surrounding the slider port in a released state; and wherein the spring-biased button can be depressed sufficiently to clear the portion of the closure body surrounding the slider port so that the slider can be displaced through the slider port; and the spring-biased button rebounds to the released state when no longer depressed; and (e) an elongate lever fixed at one end thereof to the outer surface of the slider and having an opposed free end; the lever being oriented along the displacement direction of the slider and positioned on the slider with the free end adjacent to, within, or beyond the slider port when the slider is in the closed configuration; the free end of the lever extending over the outer surface of the slider to a height sufficient for a portion of the closure body surrounding the slider port to block or engage with the lever in a released state; wherein the free end of the lever can be depressed to a height sufficient to allow the lever to clear the portion of the closure body surrounding the slider port, so that the slider can be displaced through the slider port; and the free end of the lever rebounds to the released state when no longer depressed.

Embodiment 15 comprises the container of embodiment 14; wherein the lever (e) includes one or more feature selected from the group consisting of a longitudinal split dividing the free end of the lever into two depressible parts, a groove spaced from the free end of the lever that is configured and arranged to receive a portion of the closure body surrounding the slider portal within the groove, and a head portion at the free end of the lever which extends through the slider portal in the closed configuration.

Embodiment 16 comprises the container of any one of embodiments 13 to 15, further comprising at least one raised portion on the outer surface of the slider positioned and configured to allow the slider to be advanced a selected distance through the slider port and having a sufficient height from the outer surface to be blocked by the portion of the closure body surrounding the slider port to prevent the slider from being wholly removed from the closure body in normal use.

Embodiment 17 comprises the container of embodiment 16, wherein the height of the raised portion is selectively adjustable to clear the slider port for full removal of the closure from the closure body.

Embodiment 18 comprises the container of any one of embodiments 13 to 17, wherein the slider includes a plurality of the depressible members on the outer surface thereof, and the plurality of depressible members are spaced from each other.

Embodiment 19 comprises the container of any one of embodiments 13 to 18, wherein edges of the slider ride on one or more internal tracks in the closure body.

Embodiment 20 comprises the container of any one of embodiments 13 to 18, wherein edges of the slider ride in one or more internal grooves in the closure body.

Embodiment 21 comprises the container of any one of embodiments s 13 to 20, wherein the container body defines finger grip sections to accommodate a hand grasping the container.

Embodiment 22 comprises the container of any one of embodiments 13 to 21, further comprising at least one removable locking clip engageable with the slider and closure body to prevent depressing the tab.

Embodiment 23 comprises the closure of any one of embodiments 1-10, further comprising a loop-shaped grasping head at the end of the slider closest to the slider port in the closed configuration.

Embodiment 24 comprises the container of any one of embodiments 11-22, further comprising a loop-shaped grasping head at the end of the slider closest to the slider port in the closed configuration.

BRIEF DESCRIPTION OF THE DRAWINGS

The following drawing figures are provided to illustrate certain non-limiting features of the closures and containers described herein. Other features and advantages of the described closures and containers will be apparent from the following detailed description taken in conjunction with the drawings.

DETAILED DESCRIPTION

Figure 1:
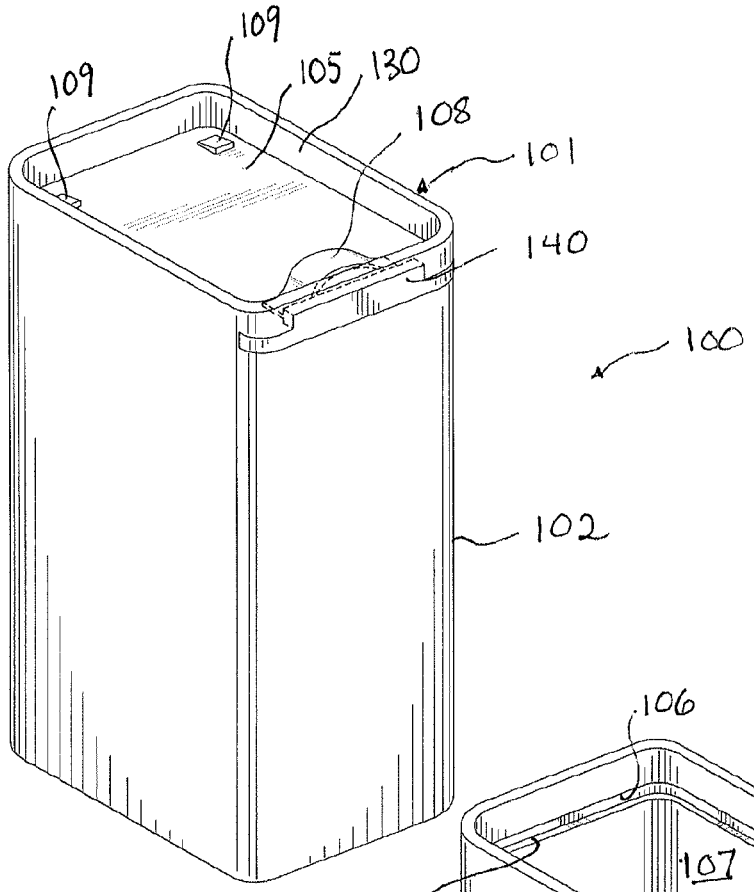
FIG. 1 shows an embodiment of a container with an integral cap portion in a closed configuration.

The sliders, depressible tabs, closure bodies, container bodies, stops, ridges, rails, and various other features thereof described herein and shown in the drawings may be fabricated as separate components that are subsequently connected (e.g. joined, fitted or mated) in an assembly process by appropriate fastening means including adhesive bonding, thermal bonding, ultrasonic welding, mechanical connection (e.g., snap-fit), hardware fastening, optical welding, RF welding, induction sealing, chemical welding, and by any other joining method. Alternatively, some components may be molded together as integral (unitary) parts. For example, or preferably, the depressible tab and slider may be fabricated as a unitary piece by molding or 3D printing processes and optionally subjected to a subsequent finishing process such as sculpting, polishing, deburring, and the like, for example. Similarly, the container body can be manufactured separately from the closure body, or the container body and closure body can be integral with each other (e.g., by molding the closure body and container body as one piece).

Containers comprising the closures described herein may contain human or animal medications, consumer goods, or any other material. The contents of the containers may be solids, including discrete or monolithic solids, semisolids and certain gels, or fluids, such as Newtonian fluids and or non-Newtonian fluids. Examples of such contents include pills, tablets, capsules, "gummy bear"-like formulations, liquids of any kind, wafers, leafs, sheets of perforated blister container tablets, powders, medicated or un-medicated shampoos, lotions, tobacco products, nicotine products, gelatins, or any other desired material The closures described herein may comprise a closure body that is integral with a container body, e.g., as in FIGS. 1-8, and 15-18, or may comprise a separate closure body (e.g., as in FIGS. 13, 13A, 14 and 19-25) that is adapted to mate with a separate container, for example, by including threading, a snap-fit element, or a press-fit element on the underside of the closure configured to mate with a complementary element on the container body. Alternatively, the separate closure may be adapted for attachment to a container body by an adhesive, thermal bonding, inductive bonding, ultrasonic bonding, or any other method of attachment suitable for use in mating closures to containers in a substantially permanent fashion.

Features of any slider described herein or illustrated in the drawings (e.g., tabs, retaining features, sealing elements, tactile cues, visual cues, and the like) can be utilized with any closure body described herein or illustrated in the drawings, with appropriate reconfiguration of closure features such as the slider portal, slider tracks, and the like, if needed, to accommodate particular slider features and configurations.

In some cases, it may be either desirable or required that a finger or an implement (e.g., a syringe, a spoon, a syringe needle, a straw, a forceps, etc.) be inserted through the main opening of the closure in order to remove the contents. If required or desired, the closure may be adapted so that the main opening comprises a stopper, a spout for liquids or solids or a piercable septum (e.g., to accommodate syringe needles), or may be adapted to include a syringe fitting (e.g., Luer connector). It is also conceivable that some contents may be removed by sipping or suction by mouth, and in such cases the container may be adapted with a mouthpiece or adapted with fittings to accommodate an attachable mouthpiece accessory. A variety of other accessories for the closures and containers described herein can be contemplated (e.g., a spoon, a net, a straw, or any other implement).

In many cases it is desirable that the slider element be retained so that it doesn't move out too far through the slider port. One way to do this is to employ at least one protrusion on the slider, e.g., at least one retaining-button or bar (i.e., a stop), which is sufficiently taller than whichever portion of the slider port that the protrusion (also referred to herein as a "retaining-feature") may contact as the slider is displaced through the slider port, to block the slider from further displacement. This can facilitate retention of the slider in the closure during ordinary usage. In some embodiments, the protrusion will be just slightly taller than the relevant portion of the slider port to enable one to detach the slider by application of a modest force sufficient to cause elastic deformation of the protrusion and/or the framing around the slider port, and in this case it is preferred that at least a portion of each retaining-feature or the framing around the slider port of the closure is polymeric. It should be understood that the slider can be reattached to the rest of the closure after removal, for example, by inserting the slider back through the slider port in the same orientation as it was when removed, and applying a modest force to the slider to pass the retaining-features back through the slider port. The retaining-features may be permanently attached to the slider by means of a permanent adhesive for example, or made part of the slider, by molding or 3D printing, for example, or semi-permanently attached by means of a pressure sensitive adhesive, a fastener, or other mechanical means (e.g., a snap-fit and the like). Such retaining-features can also further facilitate one handed opening and closing operations and this is a considerable advantage over screw-capped bottles in widespread use today, because the consumer doesn't have to handle separate pieces like a cap and a bottle, while also trying to handle the contents being removed from the container.

On the other hand, situations are envisioned where it may be desirable to make the slider non-detachable from the rest of the container closure. One situation is in a medicine container reuse program where washing protocols may vary according the medicines formerly contained in the container, and in this situation it is usually desirable that all components of the container and closure remain together. This can be accomplished, for example, in the following manner. First, the manufacturer or pharmacy fills the container; next, the manufacturer or pharmacy inserts slider; and then the manufacturer or pharmacy permanently attaches the retaining-feature to the slider, using, for example, a cyanoacrylate adhesive, where in this situation, the retaining-feature is too tall or the various contacting components are too rigid to permit passage through slider port under forces ordinarily applied by consumers without breakage.

Additionally, the distal end of a slider (i.e., the end closest to the slider port in the closed configuration) may optionally elevate upward to the height of the slider port, so as to cover or camouflage the slider port when slider is in the closed configuration, making it more difficult to determine the direction or approach for opening the container. This adds to the intellectual challenge of opening the container and increases child resistance. Alternatively, or additionally, the distal end of the slider may include a "head portion" that protrudes partly, or fully through the slider port when in the closed configuration, e.g., to provide an aid in pulling the slider through the slider port or to aid in pushing the slider back into a fully closed and locker configuration.

It should now be readily apparent that the area of the main opening exposed for access to container contents will vary according to how far the slider is displaced through the slider port, as well as by the position and shape of the main opening under the slider. The displaceable distance of the slider can, in turn, also be controlled by the placement of retaining-features on the slider. Thus, by the strategic placement of retaining-features on the slider of various embodiments of the closures described herein, or by strategic selection of the size and shape of the main opening of the closure body, a certain degree of portion control or metering can be obtained, by only uncovering part of the main opening.

If desired, finger grips can be included on the container body (e.g., as in FIG. 21), to be used in conjunction with any of the closure embodiments described herein. Such finger grips can be configured to conform, generally to one or more digits of a hand, to aid in holding on to the container during opening and closing, and can be configured for ergonomic comfort.

In some embodiments, the closure and or container can be configured so that the slider is oriented at an angle relative to the plane defined by the bottom of the container, such that during opening the slider is displaced upward at an angle away from the user when held with the slider port pointed away from the user. To open the container, the user pushes down on the depressible tab and urges the slider and the depressible tab to pass through the slider port. Closing the container is a simple matter of reversing the path of the slider. In some embodiments, the one or more depressible tabs may need to be depressed for reinsertion through the slider portal (such as those tabs shown in FIGS. 1-8). In embodiments where one or more depressible tabs are cantilevered in the direction of slider motion, the tab(s) naturally deflect when they encounter the blocking bar portion of the slider portal when being reinserted through the slider portal. The depressible tab is biased to spring back up after being pushed down and released, which generally results in an audible click for most tab and portal materials once the tab is fully returned through the slider port and the slider is back in the closed configuration. The audible click can reassure the user that the container is closed and child-resistant after use. Other forms of audible, tactile and or visual cues or assurances can be provided, if desired.

The containers and closures disclosed herein have clear ergonomic advantages over popular screw cap pharmacy bottles and others which require a twisting motion, among other motions when they possess child-resistant features. When a grip is included on the container and when the slider is oriented to move at an upward angle away from the user, as described above, opening the container is comfortable and has a low potential, if any, for adverse strain, both acute and chronic, when operated by adult consumers of average stature and health. One reason for this is because the fingers are only slightly flexed when gripping the container (provided it is sized in proportion to an adult hand), and, aside from the motion that the thumb makes, which is small, few other, if any, motions are necessary to open the container.

Containers for use in conjunction with the closures described herein can be any desired shape or size. For example, the container can have a generally round or cylindrical shape that makes it suitable for use in pharmacy industry automated filling machines which are presently standardized for cylindrical pharmacy bottles. Additionally, the container bodies may have rectangular cuboidal shape, e.g., for ergonomic reasons or improved packing efficiency relative to cylindrical containers. For instance, cuboids, i.e. rectangular parallelepipeds, as well as cubes, can achieve 100% ordered packing density when order packed, filled or unfilled, in mailing and shipping boxes when the dimensions of the boxes are integer multiples of the dimensions of the cuboid. For comparison purposes, cylindrical objects such as popular pharmacy bottles can only achieve a maximum ordered packing density of about 92%. The container bodies also can include finger grips, if desired.

The container bodies need not be entirely rigid, and may comprise some flexible elements. For example, a closure may be adapted to interface with a supple or elastic sac or pouch-type container. An exemplary interface is a rigid or semi-rigid circular or polygonal profiled tubular element extension of the closure leading into the mouth of sac or pouch, and joined, sealed or bonded by any suitable adhesive, optical, ultrasonic, mechanical (e.g., sewing, stapling, etc.) or thermal means, for example. Alternatively, the pouch or sack could include a rigid or semi-rigid adapter for attaching the closure, e.g., akin to a bottle neck and including means for engaging, sealing with, and locking onto the closure (e.g., threading, a snap-fit, adhesive bonding, thermal bonding, ultrasonic bonding, inductive bonding, and the like).

Optionally, the slider can comprise more than one depressible tab, which generally causes no undue burden for adults to operate, but provides an additional challenge for children, particularly with increasing distance of separation between the tabs. A reason for this is because it is physically challenging for a young (about five years old or less) child's digit (e.g., finger or thumb) to span separated tabs, but easy for an adult's digit to span the same distance.

Figure 16:
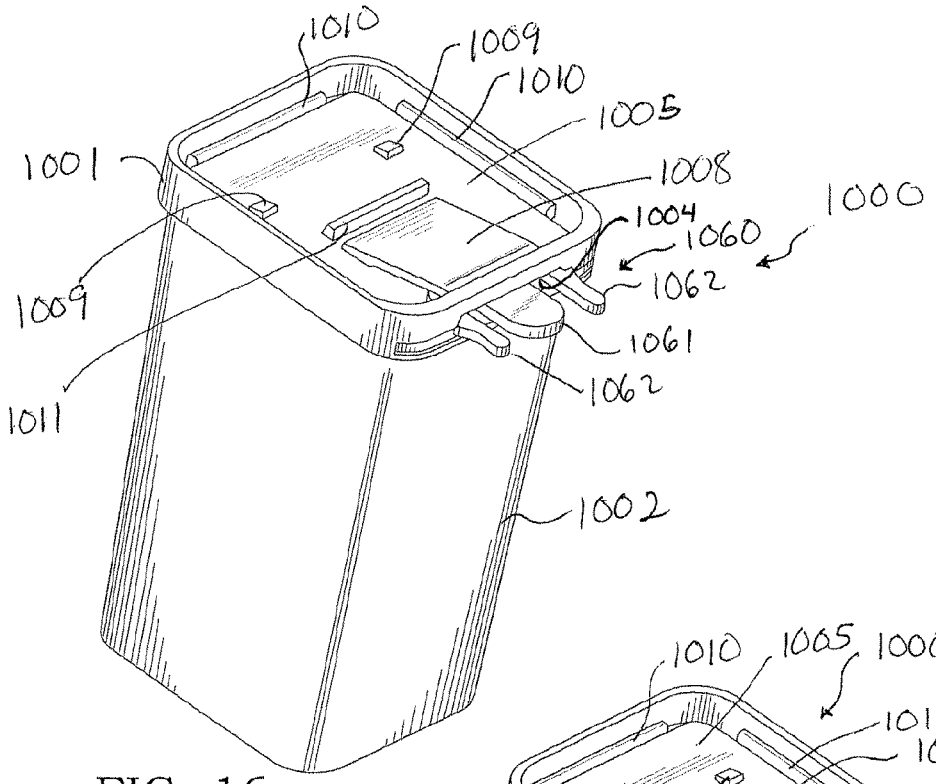
FIG. 16 shows a container embodiment that includes a locking clip to prevent the closure of the container from being opened.
Figure 17:
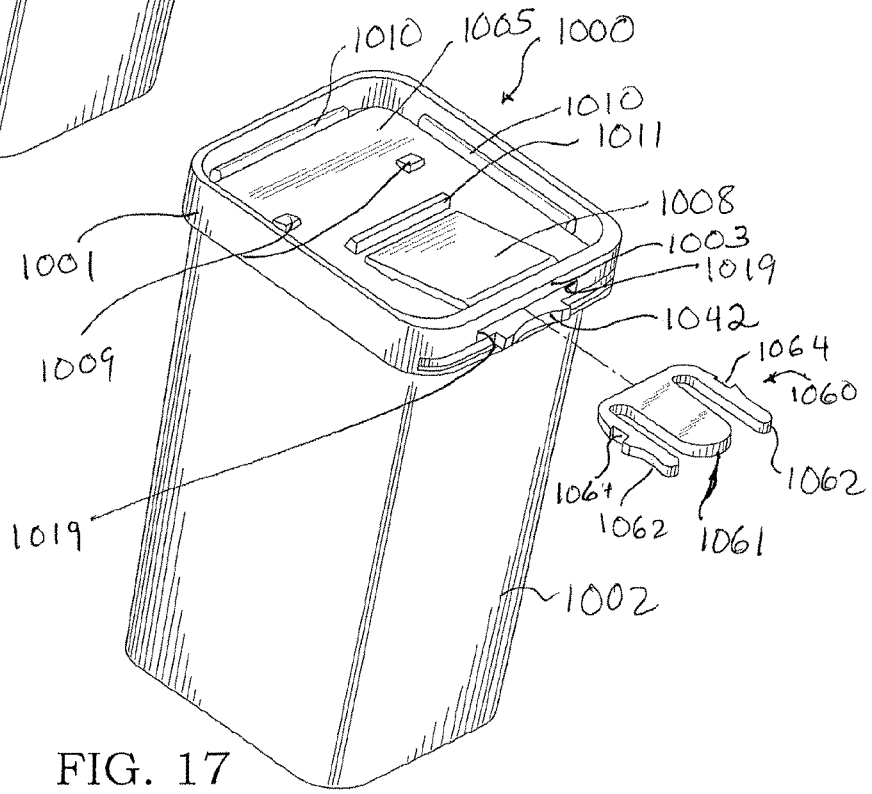
FIG. 17 shows the container of FIG. 16 with the clip removed.
Figure 18:
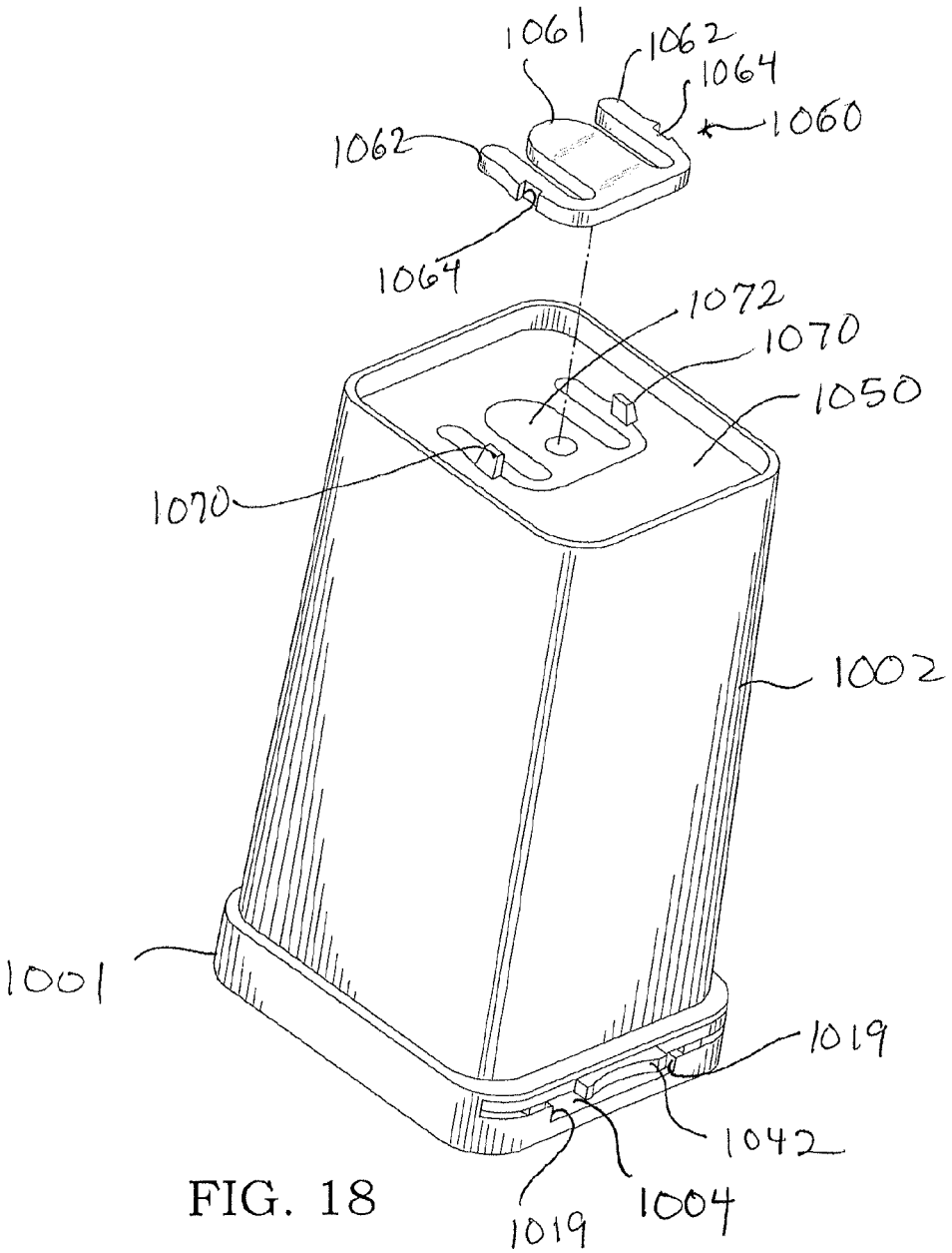
FIG. 18 shows the container of FIG. 16 with the clip removed and illustrates a clip storage mechanism on the bottom of the container for holding the clip when not in use.

Optionally, the closures may include one or more insertable locking elements to prevent the tab from being depressed or to prevent the slider form being displaced until the locking mechanism is disengaged, e.g., as in FIGS. 16-18, or as disclosed in the aforementioned Batzel patents.

The container may optionally incorporate a wrap, tape or film strategically placed over the closure-container interface, over the slider port, the main opening, or the slider, for example, to indicate tampering, to provide barrier to certain gases or liquids, for both purposes, or for other purposes. Preferred barrier materials include PVDC copolymer film and axially-oriented PET, particularly when these films are multilayered with other polymers or metals. Such wraps, tapes, or films can be bonded to the closure or closure and container using any joining technology that is suitable for the various materials involved such as, for example, adhesive, thermal bonding, and solvent, ultrasonic, RF or optical welding at strategic locations and may further include an optional pull tab. Such wraps, tapes and films also are disclosed in the aforementioned Batzel patents.

The areal dimensions and shape of the main opening need not match the dimensions or shape of the slider. In some preferred embodiments, a ledge structure or landing is present below the slider, and the main opening of the closure is defined within and framed by the ledge. The ledge structure provides for better gas and liquid sealing at the interface between the slider and the container opening. In general, the greater the surface area of contact between materials at this interface, the greater the seal.

The depressible tab is a spring-biased structure, and the force required for depressing the tab will depend on the spring constant of the biasing spring. The spring-biased structures be constructed as a cantilevered spring (e.g., as in FIGS. 7-15), a shaped flat spring (e.g., as in FIGS. 1 and 2), a traditional coiled spring, a leaf-spring, a Belleville spring (a flexible dome-shaped spring with a central opening through the center of the dome; also known as a spring washer), a Belleville-like dome spring (e.g., a resilient bubble or dome on top of the slider without central opening, such as in FIGS. 3 and 4), a gas spring (a volume of compressible gas within a flexible or variable volume housing), and the like. Generally, the force for depressing the spring-biased tab structure will depend, e.g., on the physical properties of the material from which the tab is constructed, the physical dimensions of the materials (e.g., thickness, length, width, etc.), the configuration of the spring, and the like.

Figure 12:
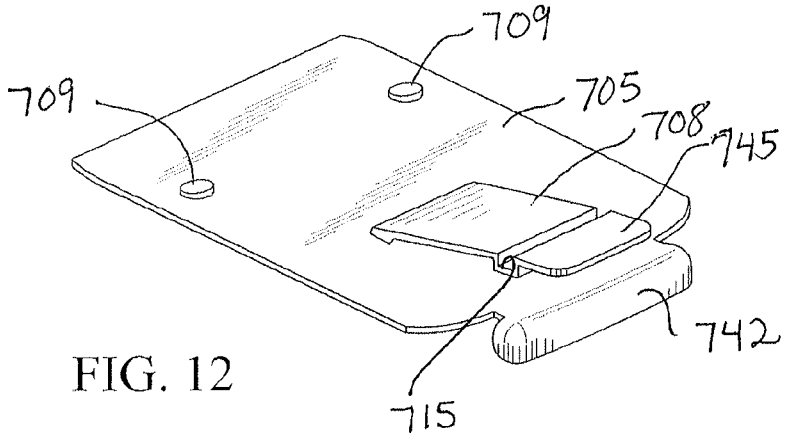
FIG. 12 illustrates a slider portion of a closure embodiment.
Figure 12A:
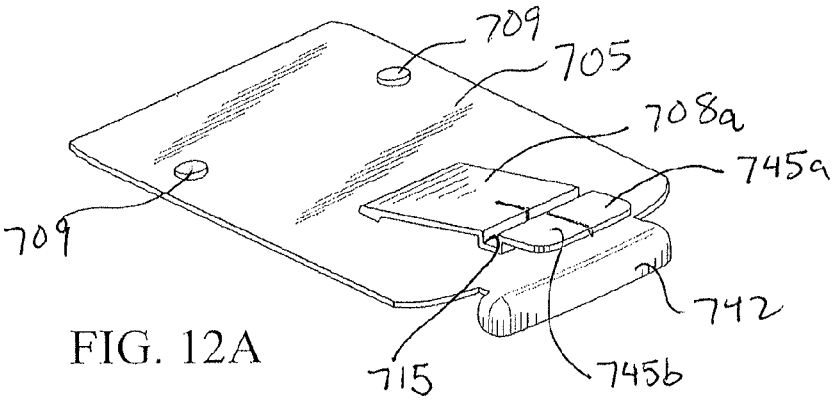
FIG. 12A illustrates an alternative form of the slider of FIG. 12.

In some embodiments, the depressible tabs can have a cantilever form (e.g., with one fixed end acting as a fulcrum structure, and an opposed free end that is angled away from the top surface of the slider, so that the tab is essentially a lever. The force required to depress the cantilevered depressible tab depends on the length of the tab as measured from the free end to the fixed fulcrum end. The closer the free end is to the fulcrum, the greater the force that will be required to depress the tab for a given tab material (e.g., type of plastic), and a given tab dimensions. The force for depressing the tab will also depend on the type of material (e.g., the type of plastic) used to form the cantilever, as well as the physical dimensions of the materials, as discussed above. Cantilevered tabs can include a partial longitudinal split, if desired, extending from the head (free end) of the cantilever toward the fulcrum of fixed end of the cantilever. The split (e.g., as shown in FIG. 12A and FIG. 13A) provide an additional level of intellectual challenge (e.g., for a child) for unlocking and displacing the slider, as both portions of the split tab must be depressed to clear the slider port for displacement through the portal. Any cantilevered tab may include such as split, if desired. The cantilevered tabs can be planar in form, partially curved in the direction from fulcrum to free end (longitudinally curved), arched from side to side (e.g., so that the middle of the cantilever is arched further from the outer surface of the slider than the edges, or so that the middle portion of the cantilever in closer to the outer surface of the slider than the edges) or any combination of such forms. Additionally, for any embodiments described herein, the outer surface of the tab (i.e., the surface that faces away from the outer surface of the slider) can include a tactile and/or visual cue, such as a "finger depression", texturing (e.g., ridges, bumps, stippling, etc.), writing, symbols, color, or a combination thereof, to aid the user in locating the most advantageous location to apply force to depress the tab and move the sider. Depressing the tab in the preferred location as provided by a cue, also minimizes undue stress and strain on the tab structure, minimizes damage and can minimize material use.

Any of the containers and closures described herein can include or be modified to include sliders with head portions which, in the fully closed position, can terminate at the beginning of the slider port, extend into the slider port or extend through the slider port, as described herein for various specific embodiments. The shape of the slider port is designed to complement the shape and configuration of the slider and depressible tab, and the presence or absence of, e.g., a head portion that extends into or through the slider port in the closed configuration. The head of the slider can be configured to aid in pulling the slider open, pushing the slider closed, or both. The head of the slider can comprise a raised structure that fills or partially fills the slider port in the closed configuration, e.g., as in FIGS. 1-8. Alternatively, the head can be designed to protrude all the way through the slider port in the closed configuration providing a shaped head such as, e.g., in FIGS. 10-18, and 20-23. In many embodiments, the head of the slider protrudes into at least a portion of the slider port. Shaped slider heads that protrude through the slider port can be utilized to aid in pulling the slider open, pushing the slider to the fully closed position, or both. Slider heads that block the slider port in the closed configuration can help hide the slider port and increase the intellectual challenge for a child to determine how to open the container.

Similarly, any of the containers and closures described herein can include or be modified to include cantilevered depressible tabs with head portions which, in the fully closed position, can terminate at the beginning of the slider port, extend into the slider port, or extend through the slider port, as described herein for various specific embodiments. The shape of the slider port is designed to complement the shape and configuration of the slider and tab, and the presence or absence of, e.g., a head portion that extends into or through the slider port in the closed configuration. The head of the tab can be configured to aid in depressing the tab, providing a sealing pressure between the closure body and the slider, providing an additional locking mechanism to maintain the tab in a closed configuration, or any combination thereof. The head of a cantilevered tab can be split longitudinally, as described herein (see e.g., FIGS. 12A and 13A) to provide additional intellectual challenges to opening the container, e.g., due to the need to depress both portions of the split tab. The shape of the slider port is adjusted to accommodate a tab head that protrudes through the slider port when the slider is closed (e.g., as in FIGS. 10 and 11).

The force required to depress the tab can be selected to achieve an optimal human factor and ergonomic performance using well known theories and methods of chemistry, materials science, mechanical engineering and physics. In general, important factors will be, e.g., material stiffness (elastic and flexural moduli), dimensions, the angle made at the junction between the depressible tab and slider, and the position along depressible tab where the downward force is applied.

There are some uses of the containers and closures described herein that may not require a tight seal (liquid or gas) between the bottom of the slider and the main opening of the closure. In many case, however, a gas-tight or liquid-tight seal will be necessary. However, as described herein, some embodiments of the closures are configured with specialized sealing features in order to maximize content integrity. Such sealing features may be important for the dispensing of medications (e.g., by prescription, over the counter, etc.), for example. According to the United Stated Pharmacopeia (USP), a package's closure for dispensing medications should fall within a "well closed" or "tight" criteria as defined by the Moisture Vapor Permeations Test (MVPR, aka MVTR, and WVTR). MVTR testing determines the moisture vapor transmission rate between a surrounding environment and a closure mechanism of a package. It is important to note that the package material type and package wall thickness also play a vital role in permeability, since diffusion of oxygen and moisture also occurs through the package material as well. However, having a satisfactory closure mechanism should ensure that the overall permeation is at a minimal level. MVTR testing for any multi-unit container without a foil seal involves randomly selecting 10 containers, and properly opening and closing each container about 30 times, filling each container approximately ⅔ of capacity at each decadent. Each container is weighed to the nearest 0.1 mg and recorded initially. Containers are stored at a constant 75±3% relative humidity and a temperature of 23±2° C. After 336±1 hours, the final weights of the individual containers are recorded. Then, using the formula below, a rate of moisture permeability may be calculated (in mg/day/L):

$$(1000/14V)[(T_F-T_1)-(C_F-C_1)], \text{ where}$$

V represents the volume (in mL) of the container, $(T_F-T_1)$ is the difference (in mg) between the final and initial weights, and $(C_F-C_1)$ is the difference (in mg) between the average final and initial weights of the 2 controls.

For containers used for drugs dispensed on prescription, results are graded as follows:

Well-Closed. Not more than 1 of the 10 containers exceeds 2000 mg/day/L in moisture permeability, and none exceeds 3000 mg/day/L in moisture permeability; and Tight: Not more than 1 of the 10 containers exceeds 100 mg/day/L in moisture permeability, and none exceed 200 mg/day/L. For containers to be considered "tight", an additional foil seal is usually necessary, e.g. for medications that need to have a greater shelf life such as over the counter medications.

One way to create a good seal is to match polish the dimensions of the materials used for the closure body and slider precisely to make a tight fit. Another way is to take advantage of the spring behavior of cantilever style depressible tabs, and to engage a portion of the tab with the framing structure around the slider port to create a positive downward force opposing the biasing of the cantilever, which is then translated to the slider an underlying structure of the closure body. Another way to achieve this sealing function is using raised structures on the outer surface of the slider (e.g., ridges, rails or bumps) that will engage with, and be partially compressed by, complementarily arranged structures (e.g., a shaped ridge or rail) on the closure body when the sider is fully closed (i.e., to create an interference fit, which causes a positive sealing force between the bottom of the slider and the underlying structures of the closure body that contact the slider). The constant contact and the force between the slider and the underlying portions of the closure body can be made to vary by adjusting the geometry, dimensions and material properties of the various components to produce a positive seal appropriate for the contents of the container and the environmental conditions that the container is exposed.

Another embodiment achieving a good seal is to include a flexible or resilient element on the bottom of the slider or on a ledge below the slider in which the main opening of the closure is defined. The resilient element can deform slightly under pressure created by the structures holding the slider in place in the closed configuration to create a seal around the main opening. Such a resilient element can be, e.g., a "crab claw" element, a resilient coating, or a resilient layer on either the slider bottom or the ledge surrounding main opening. A "crab claw" seal element is named after its shape, due to a general resemblance between the appearances of the sealing surface (when viewed in side section) to the profile of a crab claw. Typically, a crab claw comprises a thin flexible seal that compresses against a sealing surface. A crab claw may have a pronounced symmetric curvature and have a footprint that corresponds to the surface of the ledge, and may be comprised of a thin, flexible material of generally uniform wall thickness. These characteristics permit the crab claw, when slider is compressed downward, to push against the ledge surface in order to form a gasket-like seal between the slider and the ledge. Other sealing structures are described in the aforementioned Batzel patents.

Optionally, the ledge or landing upon which the slider moves (e.g., a rail, the bottom of a groove, a platform, etc.), or the bottom of the slider, or both, can include a sealing structure that will provide an air-tight or fluid-tight seal around the main opening of the closure to aid in preventing contamination and leakage of the contents of the container. For example, a relatively soft or compressible gasket, either inserted into slider-groove or inserted around the slider may be employed to improve the gas and liquid seal provided said gasket doesn't substantially interfere with the motion of the slider. Preferably, any sealing or gasket element employed is molded to have a precise noninterfering shape. In some embodiments the gasket comprises a raised ridge on the top (outward-facing) side of a ledge framing the main opening, which contacts and seals with the interior side of the slider when in the closed configuration. In some other embodiments the gasket comprises a raised ridge on the bottom (interior-facing) side of the slider, positioned so as to frame and seal the main opening when the slider is in the closed configuration. In yet other embodiments the sealing element comprises a raised ridge as described above, and a complementary trough configured to mate with the ridge when the slider is in the closed configuration, in which case the ridge would be formed on one surface (either the bottom of the slider or the top of the ledge or platform) and the trough would be defined on the opposed surface.

In some cases, debris (e.g., powder from broken medicine tablets), may collect in the slider-grooves, and underlying ledge, and the like. One way to allow such debris to be self-cleared, is to include a secondary opening on a face of the closure opposite the slider port, so that when the slider is returned to the closed configuration, and underlying debris is pushed out through the secondary opening. If such a secondary opening is included, the travel of the slider towards the secondary opening needs to be limited, e.g., by a stop on the slide, the secondary opening, or both. One way is to employ one or more sufficiently tall protrusions on the slider and proximal to the secondary opening. Another way is to make the height of the secondary opening shorter than the height of the slider. Alternatively, the closure body can be designed so that there is minimal framing where the tail end of the slider (i.e., the end opposite the head of the slider) rests in the closed configuration, and the tail end of the slider is only restrained in selected locations.

In some embodiments, multiple containers with individual slider closures may be joined together, in any suitable arrangement (e.g., side-by-side, bottom-to-bottom, side-by-side and bottom-to-bottom, and the like). Alternatively, or in addition, a single container body may comprise multiple independent internal chambers for holding different contents, which each chamber being associated with a separate slider arrangement. In yet other embodiments, a single container body may comprise multiple independent internal chambers for holding different contents, and a single slider or sliding closure may be used to access two side-by-side chambers, using a slider that can be selectively displaced in two opposed directions to two different open configurations, from a single closed configuration.

Various portions of the container body or closure may be made opaque, to various extents, to selected wavelengths of electromagnetic radiation, such as ultraviolet light and visible light for example, and to various energetic particles. One reason for doing this is to maintain the purity of contents that would otherwise be affected by certain wavelengths or particles. Another reason is to shield workers and consumers from dangerous radiation or particles emitted by radioactive contents. Means for blocking selected wavelength of light or blocking other forms of radiation are well known in the materials art.

In a similar vein, the container body or closure may be made less permeable to certain gas and liquid permeates, in particular oxygen and water vapor, by increasing the thickness, of by judicious selection of materials, as is well known in the packaging art.

Frequently in the design of containers for foods and medicines it is necessary to consider whether or not any substances, such as plasticizers and monomers for example, might migrate from the container body or closure to contaminate the contents of the container. Appropriate materials for constructing the container body and closure to avoid such contamination are well known in the packaging art.

A force between the slider and its supporting structures can be generated that provides for a better seal. Sealing is often better when a relatively softer material presses against a relatively harder material, or when both materials are relatively soft. For example, one may use a softer thermoplastic elastomer for the slider and a harder thermoplastic material, such as polypropylene, as part of the bottom-ledges of the slider-groove. When regulatory guidelines limit the selection of materials to standard materials such as polypropylene then to provide for a better has and liquid seal one can use polypropylene for both the slider and the bottom-ledges and employ a third softer gasketing material between them. Alternatively one may apply, fit, mold or otherwise include a softer element on the bottom of a polypropylene slider, around the perimeter of the main opening, or both, in order to achieve better sealing.

General manufacturing methods can be used to prepare the closure bodies, sliders and container bodies, and include injection molding, particularly when thermoplastic or elastomeric materials are used, as well as overmolding techniques when for example metallic materials are surrounded with plastic, or blow molding, particularly when glass or plastic materials are employed. Various parts or components may be manufactured separately and then assembled. In fact, in some cases in order to facilitate filling it may be desirable to separately fabricate a portion, side or face of a container body or closure, and subsequently permanently join the portion, side or face to the rest of the container body or closure.

Figure 2:
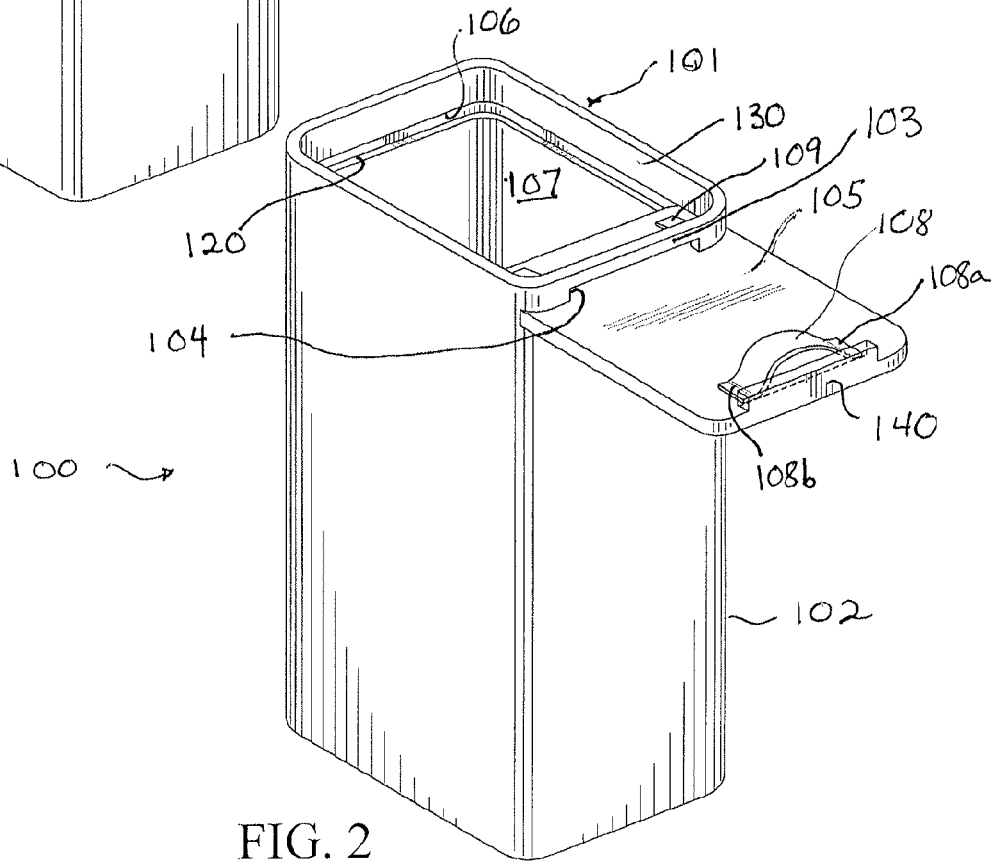
FIG. 2 shows the container of FIG. 1 in an open configuration.

FIG. 1 and FIG. 2, show, in perspective views, an embodiment of a safety container in a closed and locked state (FIG. 1) and an open and unlocked state (FIG. 2). Referring to FIGS. 1 and 2, the container 100 comprises a container body 102 integrally joined to a closure portion 101 comprising slider 105 engaged within frame 130. Stops 109, which aid in preventing slider 105 from being inadvertently removed from closure portion 101 protrude from the upper surface of slider 105. Stops 109 and/or frame 130 preferably are composed of a resilient material so that the stops and/or frame can be deformed by applying a force on slider 105 in excess of the force required to merely open the container, so that stops 109 can pass through slider port 104 to completely remove slider 105 from closure portion 101. It should be understood that slider 105 can be reattached to the rest of the closure portion 101, or attached for the first time, by inserting the slider back into slider port 104 and applying a modest force to urge stops 109 through slider port 104. Stops 109 may be permanently attached to slider 105 by means of a permanent adhesive, for example, or may be made part of the slider (e.g., by molding or 3D printing) or may be removeably attached (e.g., by means of a pressure sensitive adhesive, by screwing into the surface of slider 105, and the like).

Depressible tab 108 protrudes from the upper surface of slider 105 to a height greater than the height of slider port 104 and is positioned adjacent the portion of frame 130 that comprises blocking bar 103 and defines slider port 104. Tab 108, in its resting, non-depressed state, prevents slider 105 from being displaced through slider port 104. When the user wishes to open container 100, slider 105 can be displaced through slider port 104 by depressing tab 108 and urging the slider though slider port 104 to uncover main opening 107. Head portion 140 extends from the end of slider 105 and is adapted and arranged to fill slider port 104 when the slider is the closed configuration shown in FIG. 2. Slider 105 rides within slider groove 106 in frame 130, with the bottom peripheral edge of slider 105 resting upon landing 120 of slider groove 106. Optionally, landing 120 of slider groove 106 can partially extend inward forming a platform or ledge restricting the size of main opening 107 to any desired shape or size.

In FIGS. 1 and 2, depressible tab 108 is in the form of a resilient, arched elongate flat spring attached at both ends (108*a* and 108*b*) thereof to slider 105. Tab 108 is positioned parallel to head portion 140 and spaced from head portion 140 by slightly more than the width of blocking bar 103, so that in the closed configuration tab 108 is adjacent to blocking bar 103 and prevents displacement of slider 105 through slider port 104. Access to the container contents is accomplished by depressing tab 108 to a height that clears blocking bar 103 and urging the slider through slider port 104 a distance sufficient to allow access to the contents of the container. While slider 105 is shown flat in FIGS. 1 and 2, it can alternatively be of curved (arcuate) form, with the other components of the closure 101 adapted, as needed, to accommodate the curvature.

Depressible tab 108 acts as a compressible machined spring, which rebounds once released from its compressed state. Optionally, more than one tab 108 may be present on slider 105, depending on the size of the slider and tabs. Alternatively, the elongate band of tab 108 may be permanently affixed on one end, and merely restrained at its other end, either by some engagement with slider 105 (e.g., a slot, a loop or other means of holding the non-fixed end in place) or by the curvature of the band making up tab 108. As another alternative, both ends of tab 108 may be restrained in contact with slider 105 by insertion into slots, loops, or the like. The band may be composed of any material (e.g., plastic, metal, or ceramic) that will not undergo permanent deformation under normal usage conditions (such as that generated by an adult's fingertip pressure).

As described above, slider port 104 is filled and covered by head 140 when the slider 105 is in the closed configuration making it more difficult to see and/or determine the direction or approach to open the container. This adds to the intellectual challenge of opening the container and increases child resistance. Optionally, head 140 may be omitted if desired. Optionally, stops 109 may also be omitted, if desired.

Figure 3:
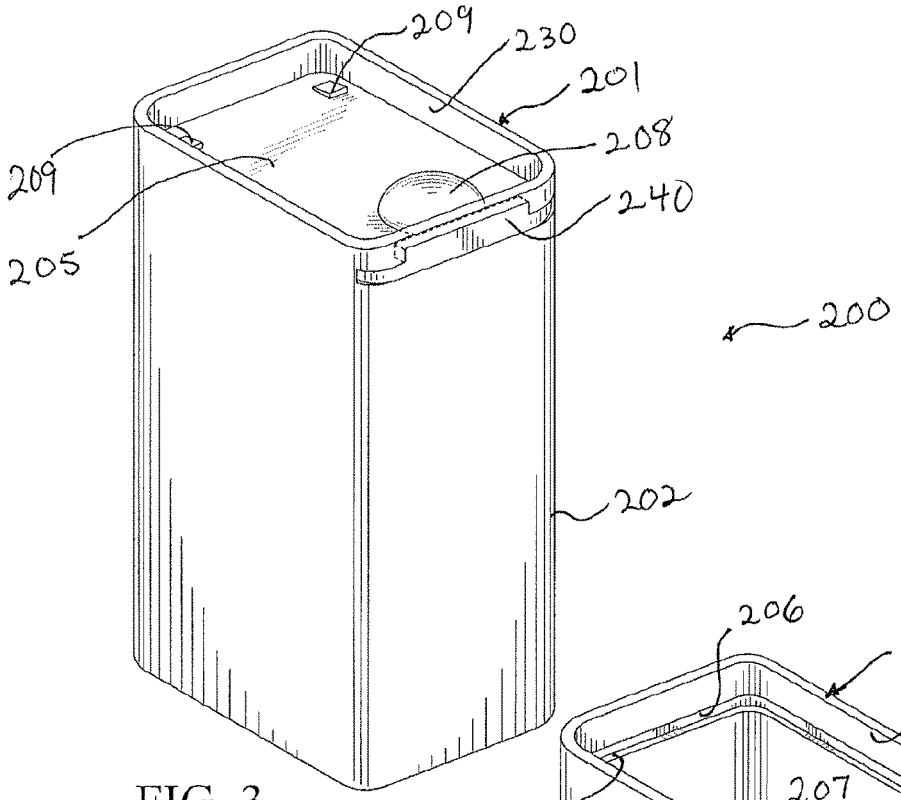
FIG. 3 shows an embodiment of a container with an integral cap portion in a closed configuration.
Figure 4:
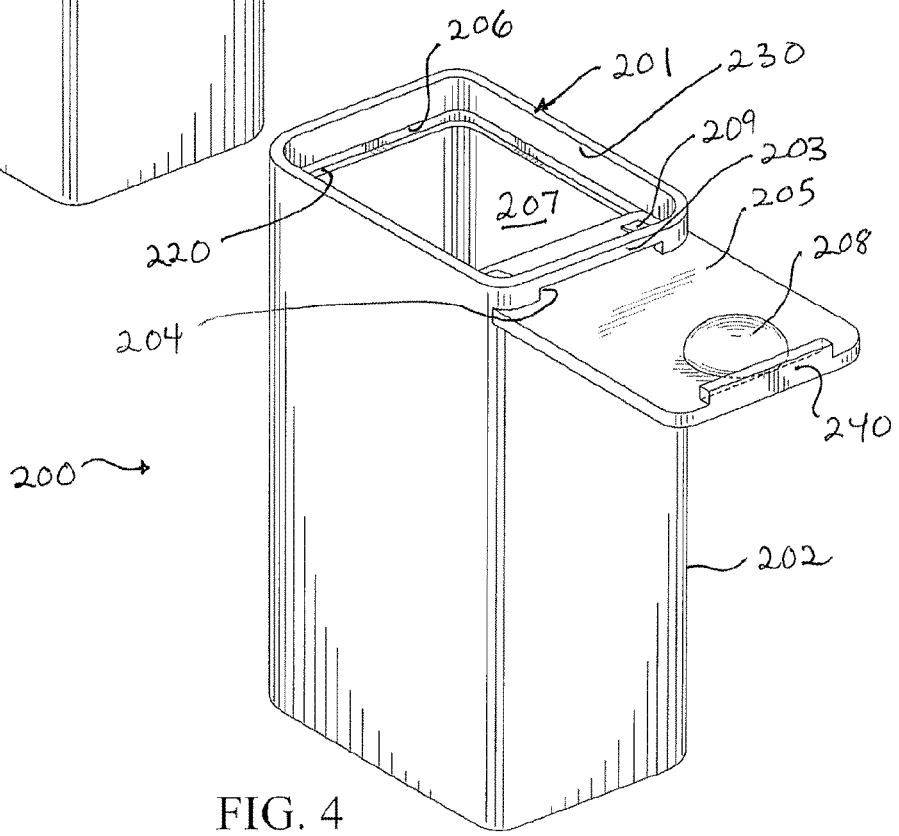
FIG. 4 shows the container of FIG. 3 in an open configuration.

FIG. 3 and FIG. 4, show, in perspective views, an embodiment of a safety container in a closed and locked state (FIG. 3) and an open and unlocked state (FIG. 4). Referring to FIGS. 3 and 4, the container 200 comprises container body 202 integrally joined to a closure portion 201 comprising slider 205 engaged within frame 230. Stops 209, which aid in preventing slider 205 from being inadvertently removed from closure portion 201 protrude from the upper surface of slider 205. Stops 209 and/or frame 230 preferably are composed of a resilient material so that the stops and/or frame can be deformed by applying a force on slider 205 in excess of the force required to merely open the container, so that stops 209 can pass through slider port 204 to completely remove slider 205 from closure portion 201. It should be understood that slider 205 can be reattached to the rest of the closure portion 201, or attached for the first time, by inserting the slider back into slider port 204 and applying a modest force to urge stops 209 through slider port 204. Stops 209 may be permanently attached to slider 205 by means of a permanent adhesive, for example, or may be made part of the slider (e.g., by molding or 3D printing) or may be removably attached (e.g., by means of a pressure sensitive adhesive, by screwing into the surface of slider 205, and the like).

Depressible tab 208 protrudes from the upper surface of slider 205 to a height greater than the height of slider port 204 and is positioned adjacent the portion of frame 230 that comprises blocking bar 203 and defines slider port 204. Tab 208, in its resting, non-depressed state, prevents slider 205 from being displaced through slider port 204. When the user wishes to open container 200, slider 205 can be displaced through slider port 204 by depressing tab 208 and urging the slider though slider port 204 to uncover main opening 207. Head portion 240 extends from the end of slider 205 and is adapted and arranged to fill slider port 204 when the slider is the closed configuration shown in FIG. 4. Slider 205 rides within slider groove 206 in frame 230, with the bottom peripheral edge of slider 205 resting upon landing 220 of slider groove 206. Optionally, landing 220 of slider groove 206 can partially extend inward forming a platform or ledge restricting the size of main opening 207 to any desired shape or size.

In FIGS. 3 and 4, depressible tab 208 is in the form of a resilient dome spring, which can be open to the inner side of the slider, can be closed-off and hollow (e.g., a gas filled bubble-like structure), or can be closed-off and filled with, or composed of, a resilient solid material. Tab 208 is positioned adjacent head portion 240 and spaced from head portion 240, so that in the closed configuration tab 208 is adjacent to blocking bar 203 and prevents displacement of slider 205 through slider port 204. Access to the container contents is accomplished by depressing depressible tab 208 to a height that clears blocking bar 203 and urging the slider through slider port 204 a distance sufficient to allow access to the contents of the container. While slider 205 is shown flat in FIGS. 3 and 4, it can alternatively be of curved (arcuate) form, with the other components of the closure 201 adapted, as needed, to accommodate the curvature.

Depressible tab 208 acts as a compressible spring which rebounds once released from its compressed state. Optionally, more than one tab 208 may be present on slider 205, depending on the size of the slider and tabs. Tab 208 may be composed of any material that will not undergo permanent deformation under normal usage conditions (such as that generated by an adult's fingertip pressure). In some embodiments, tab 208 is a hollow dome of resilient plastic filled with a gas. In some other embodiments, tab 208 is a dome of resilient plastic filled with a resilient foam or gel material. In some other embodiments, tab 208 is a dome that is hollow and open to the inner side of the slider 205.

As described above, slider port 204 is filled and covered by head portion 240 when the slider 205 is in the closed configuration making it more difficult to see and/or determine the direction or approach to open the container. This adds to the intellectual challenge of opening the container and increases child resistance. Optionally, head portion 240 may be omitted if desired. Optionally, stops 209 may also be omitted, if desired.

Figure 5:
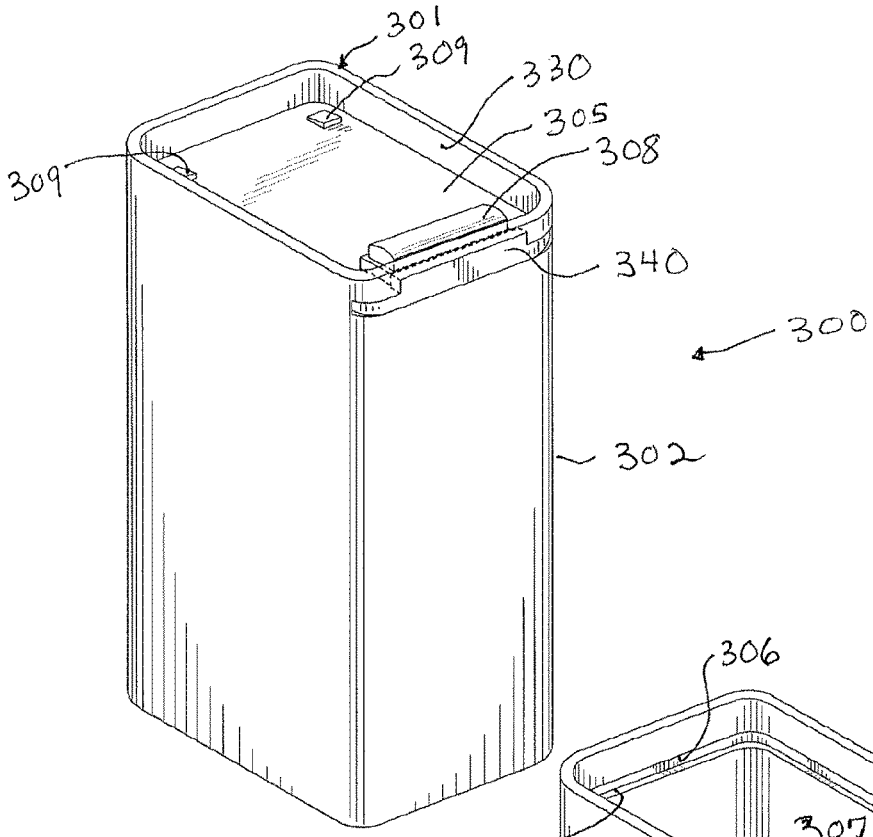
FIG. 5 shows an embodiment of a container with an integral cap portion in a closed configuration.
Figure 6:
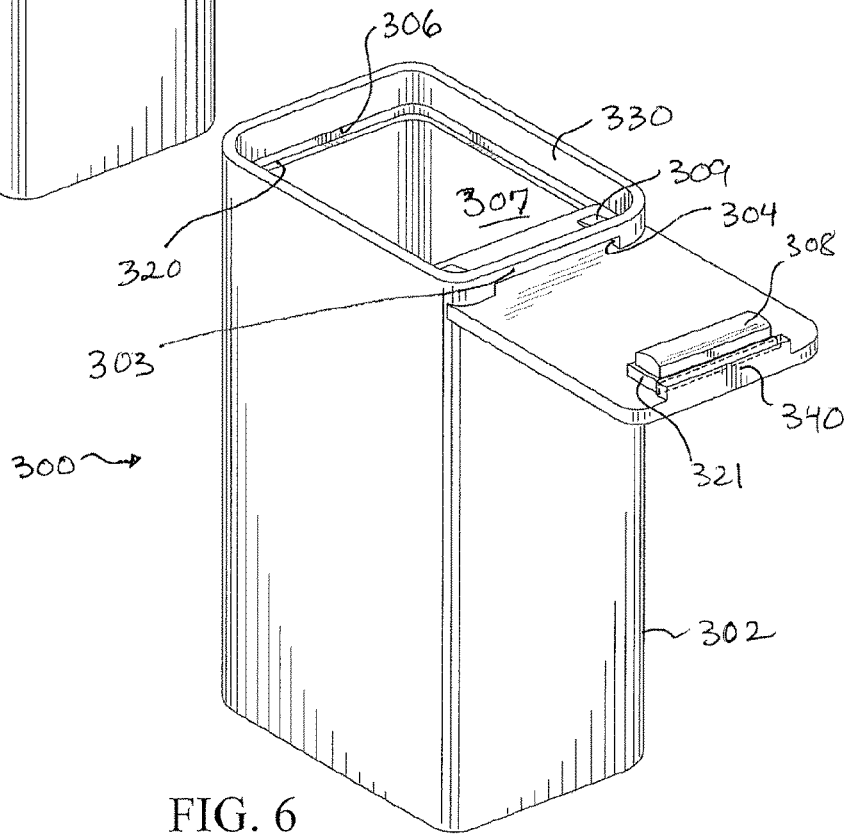
FIG. 6 shows the container of FIG. 5 in an open configuration.

FIG. 5 and FIG. 6, show, in perspective views, an embodiment of a safety container in a closed and locked state (FIG. 5) and an open and unlocked state (FIG. 6). Referring to FIGS. 5 and 6, the container 300 comprises container body 302 integrally joined to a closure portion 301 comprising slider 305 engaged within frame 330. Stops 309, which aid in preventing slider 305 from being inadvertently removed from closure portion 301 protrude from the upper surface of slider 305. Stops 309 and/or frame 330 preferably are composed of a resilient material so that the stops and/or frame can be deformed by applying a force on slider 305 in excess of the force required to merely open the container, so that stops 309 can pass through slider port 304 to completely remove slider 305 from closure portion 301. It should be understood that slider 305 can be reattached to the rest of the closure portion 301, or attached for the first time, by inserting the slider back into slider port 304 and applying a modest force to urge stops 309 through slider port 304. Stops 309 may be permanently attached to slider 305 by means of a permanent adhesive, for example, or may be made part of the slider (e.g., by molding or 3D printing) or may be removeably attached (e.g., by means of a pressure sensitive adhesive, by screwing into the surface of slider 305, and the like).

Depressible tab 308 protrudes from the upper surface of slider 305 to a height greater than the height of slider port 304 and is positioned adjacent the portion of frame 330 that comprises blocking bar 303 and defines slider port 304. Tab 308, in its resting, non-depressed state, prevents slider 305 from being displaced through slider port 304. When the user wishes to open container 300, slider 305 can be displaced through slider port 304 by depressing tab 308 and urging the slider though slider port 304 to uncover main opening 307. Head portion 340 extends from the end of slider 305 and is adapted and arranged to fill slider port 304 when the slider is the closed configuration shown in FIG. 6. Slider 305 rides within slider groove 306 in frame 330, with the bottom peripheral edge of slider 305 resting upon landing 320 of slider groove 306. Optionally, landing 320 of slider groove 306 can partially extend inward forming a platform or ledge restricting the size of main opening 307 to any desired shape or size.

In FIGS. 5 and 6, depressible tab 308 is in the form of a spring-biased bar, which is engaged with a base 321 on the outer surface of slider 305 with a spring or spring-like material such as a resilient foam (not shown) housed between tab 308 and base 321. Tab 308 is moveable within base 321 and is retained in base 321 by any convenient or desired means, e.g., by catches or protrusions on an inner edge of tab 308 that engages with a mated catch or protrusion on an inner edge of base 321. Tab 308 is positioned adjacent head portion 340 and spaced from head portion 340, so that in the closed configuration tab 308 is adjacent to blocking bar 303 and prevents displacement of slider 305 through slider port 304. Access to the container contents is accomplished by depressing depressible tab 308 to a height that clears blocking bar 303 and urging the slider through slider port 304 a distance sufficient to allow access to the contents of the container. While slider 305 is shown flat in FIGS. 5 and 6, it can alternatively be of curved (arcuate) form, with the other components of the closure 301 adapted, as needed, to accommodate the curvature.

Depressible tab 308 acts as a compressible spring which rebounds once released from its compressed state. Optionally, more than one tab 308 may be present on slider 305, depending on the size of the slider and tabs. Tab 308 may be composed of any material (e.g., plastic, metal, ceramic; etc.) and is spring-based to be depressible by the force such as that generated by an adult's fingertip pressure. Upon release of the force, tab 308 rebounds.

As described above, slider port 304 is filled and covered by head portion 340 when the slider 305 is in the closed configuration making it more difficult to see and/or determine the direction or approach to open the container. This adds to the intellectual challenge of opening the container and increases child resistance. Optionally, head portion 340 may be omitted if desired. Optionally, stops 309 may also be omitted, if desired.

Figure 7:
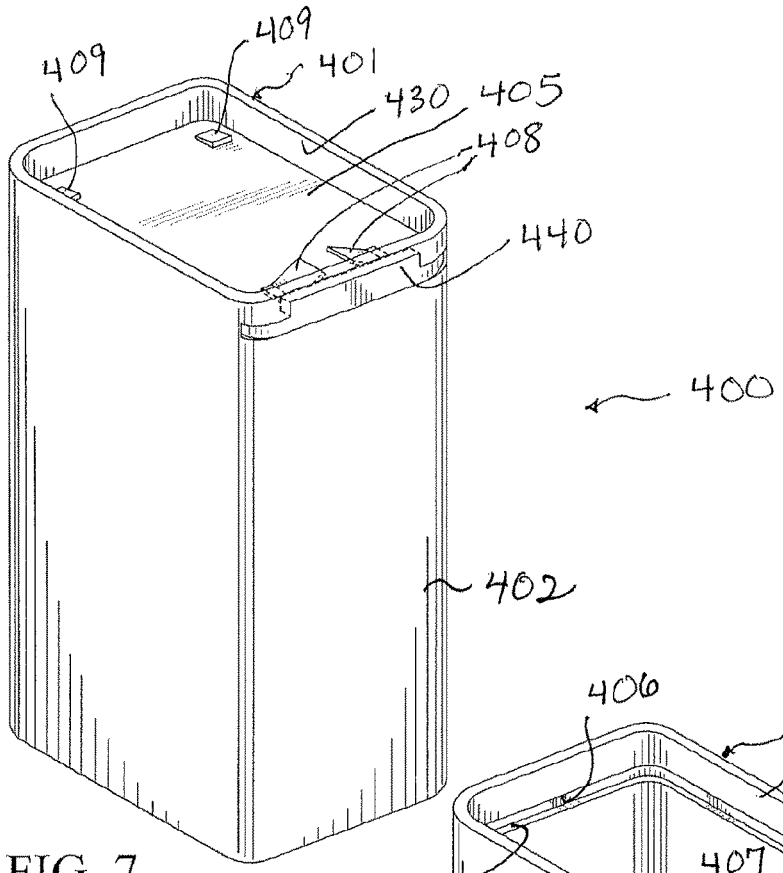
FIG. 7 shows an embodiment of a container with an integral cap portion in a closed configuration.
Figure 8:
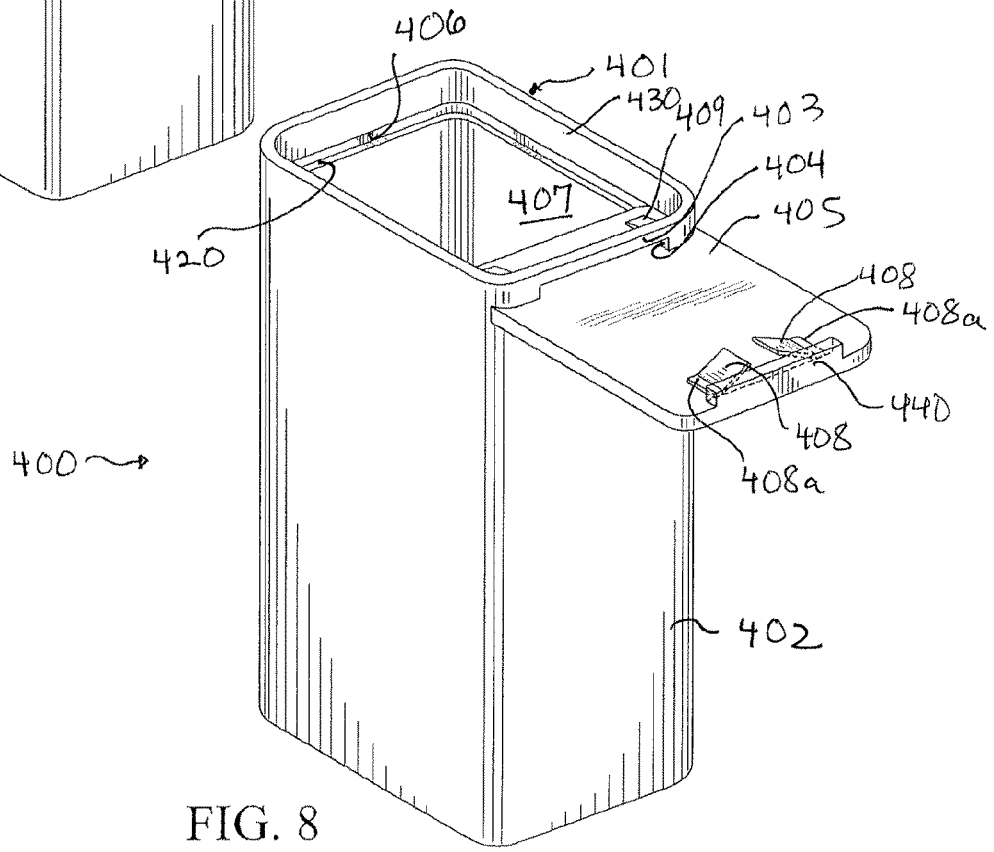
FIG. 8 shows the container of FIG. 7 in an open configuration.

FIG. 7 and FIG. 8 show, in perspective views, an embodiment of a safety container in a closed and locked state (FIG. 7) and an open and unlocked state (FIG. 8). Referring to FIGS. 7 and 8, the container 400 comprises container body 402 integrally joined to a closure portion 401 comprising slider 405 engaged within frame 430. Stops 409, which aid in preventing slider 405 from being inadvertently removed from closure portion 401 protrude from the upper surface of slider 405. Stops 409 and/or frame 430 preferably are composed of a resilient material so that the stops and/or frame can be deformed by applying a force on slider 405 in excess of the force required to merely open the container, so that stops 409 can pass through slider port 404 to completely remove slider 405 from closure portion 401. It should be understood that slider 405 can be reattached to the rest of the closure portion 401, or attached for the first time, by inserting the slider back into slider port 404 and applying a modest force to urge stops 409 through slider port 404. Stops 409 may be permanently attached to slider 405 by means of a permanent adhesive, for example, or may be made part of the slider (e.g., by molding or 3D printing) or may be removeably attached (e.g., by means of a pressure sensitive adhesive, by screwing into the surface of slider 405, and the like).

Depressible tabs 408 protrude from the upper surface of slider 405 to a height greater than the height of slider port 404 and is positioned adjacent the portion of frame 430 that comprises blocking bar 403 and defines slider port 404. Tabs 408, in their resting, non-depressed states, prevent slider 405 from being displaced through slider port 404. When the user wishes to open container 400, slider 405 can be displaced through slider port 404 by depressing tabs 408 and urging the slider though slider port 404 to uncover main opening 407. Head portion 440 extends from the end of slider 405 and is adapted and arranged to fill slider port 404 when the slider is the closed configuration shown in FIG. 8. Slider 405 rides within slider groove 406 in frame 430, with the bottom peripheral edge of slider 405 resting upon landing 420 of slider groove 406. Optionally, landing 420 of slider groove 406 can partially extend inward forming a platform or ledge restricting the size of main opening 407 to any desired shape or size, e.g., as in platform 612 in FIG. 10.

In FIGS. 7 and 8, depressible tabs 408 are in the form of a pair of opposed, cantilevered strips which each have a fixed end (408 *a*) attached to the upper surface of slider 405 and an opposite free end raised above the outer surface of slider 405 to a height greater than the height of slider port 404. The free ends of tabs 408 face one another. Each tab 408 is aligned parallel to head portion 440 and spaced from head portion 440, so that in the closed configuration tabs 408 are adjacent to blocking bar 403 and prevent displacement of slider 405 through slider port 404. Access to the container contents is accomplished by depressing depressible tabs 408 to a height that clears blocking bar 403 and urging the slider through slider port 404 a distance sufficient to allow access to the contents of the container. While slider 405 is shown flat in FIGS. 7 and 8, it can alternatively be of curved (arcuate) form, with the other components of the closure 401 adapted, as needed, to accommodate the curvature.

Depressible tabs 408 act as compressible springs which rebound once released from their compressed state. Optionally, the free ends of tabs 408 may be spaced apart from each other at a distance sufficient for a single adult digit (finger or thumb) to depress both tabs 408 at once, but far enough apart to make it difficult for a single juvenile digit (finger or thumb) to depress both tabs 408 at the same time. Tabs 408 may be composed of any material (e.g., plastic, metal, ceramic; etc.) that is sufficiently resilient to repeatedly spring back up when released.

As described above, slider port 404 is filled and covered by head portion 440 when the slider 405 is in the closed configuration making it more difficult to see and/or determine the direction or approach to open the container. This adds to the intellectual challenge of opening the container and increases child resistance. Optionally, head portion 440 may be omitted if desired. Optionally, stops 309 may also be omitted, if desired. An alternative embodiment may include just one tab 408, instead of two or more.

Figure 9:
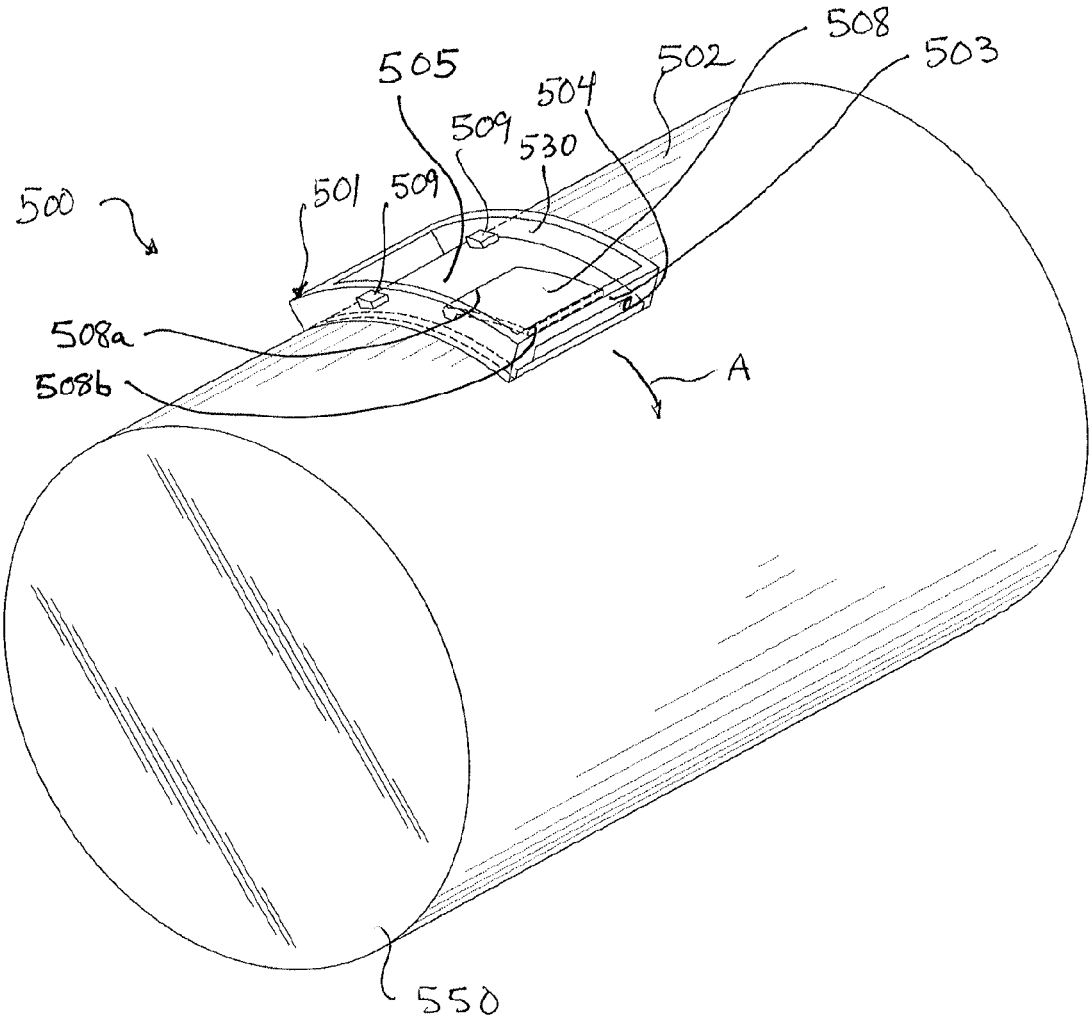
FIG. 9 shows another container embodiment with a cylindrical body.

Optionally, closure portions or bodies 101, 201, 301 and 401 of FIGS. 1 through 8 may be included in a separate cap (e.g., as in FIGS. 13, 14, and 19-25), rather than as an integral part of the container body, as will be readily understood by those of ordinary skill in the art upon reading the present disclosure FIG. 9 shows an alternative embodiment of a safety container 500, which comprises a cylindrical container body 502, closed at both ends by endcaps 550. Closure body 501 is mounted on container body 502 and comprises frame 530 defining slider port 504 topped with blocking bar 503. Slider 505 is mounted within frame 530 in the same manner as sliders 105, 205, 305, and 405 are mounted in frames 130, 230, 330, and 430 in FIGS. 1, 2, 3, and 4, respectively, except that slider 505 is curved and is mounted within a curved groove in frame 530. FIG. 9 shows slider 505 in a closed configuration which covers a main opening into container 500, as in FIGS. 1 through 8. Slider 505 includes stops 509 which serve the same function and are constructed in the same manner as stops 109, 209, 309, and 409 in FIGS. 1, 2, 3, and 4, respectively.

Depressible tab 508 extends from the outer surface of slider 505. In FIG. 9, depressible tab 508 is in the form of a single cantilevered bar, which is fixed at one end 508*a* to the outer surface of slider 505, and has an opposite free end 508*b* disposed adjacent to blocking bar 503 above slider port 504. Free end 508*b* of tab 508 is raised above the surface of slider 505. Frame 530 and slider 505 are oriented so that the curvature of the frame and the slider follow the curvature of cylindrical body 502, and slider 505 opens by sliding parallel to endcaps 550 in the direction of curved arrow A. The container is opened by depressing the free end of tab 508 sufficiently to clear blocking bar 503, and urging slider 505 and tab 508 through slider port 504. Upon release, the free end of tab 508 rebounds to its original height above the outer surface of slider 505. To close container 500, slider 505 is simply urged back through slider port 504 in the reverse of its opening, which automatically depresses tab 508 to clear blocking bar 503. Optionally, more than one tab 508 may be included on slider 505, and/or tab 508 can be replaced by any other tab form described herein (e.g., tabs such as are shown in FIGS. 1-8).

Figure 10:
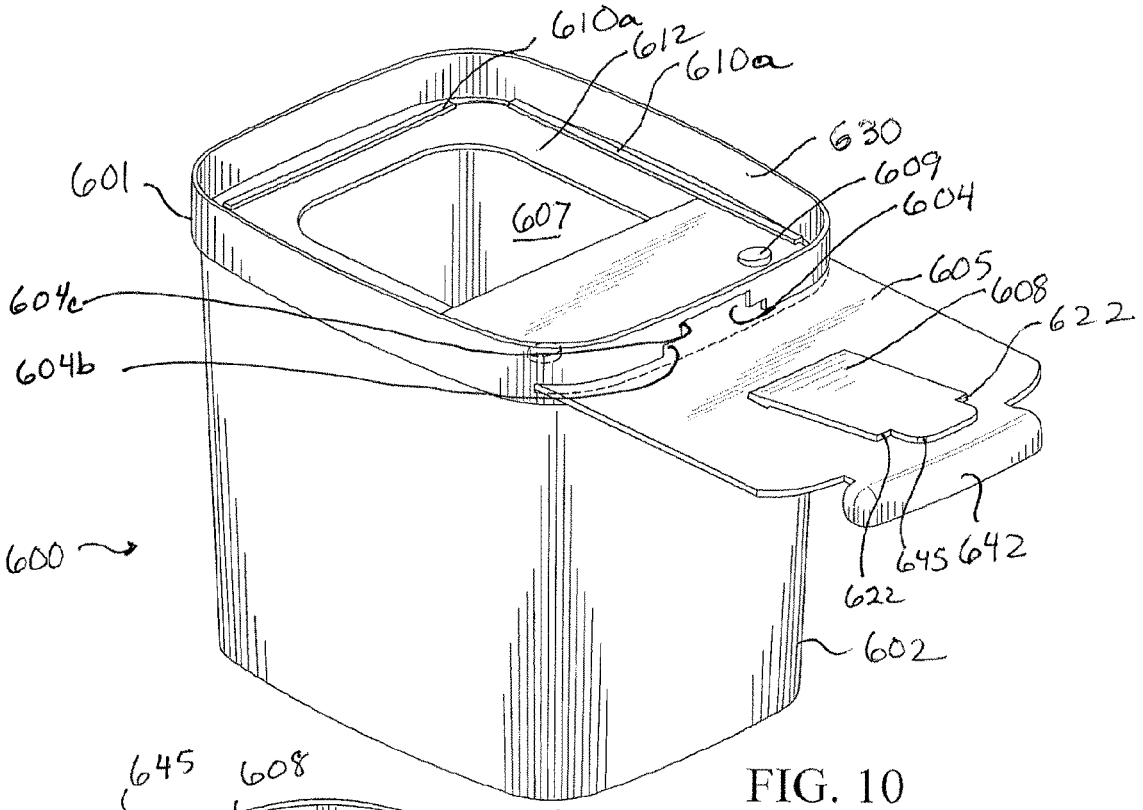
FIG. 10 shows a container embodiment in an open configuration.
Figure 11:
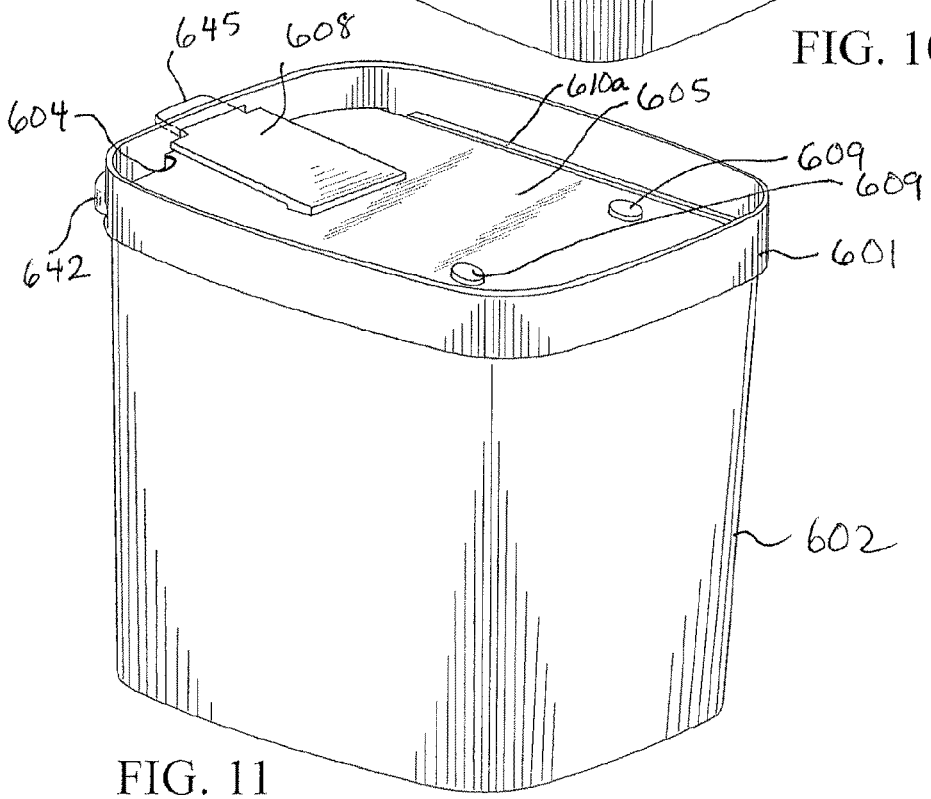
FIG. 11 shows the container of FIG. 10 in a closed configuration.

FIG. 10 and FIG. 11 show, in perspective views, an embodiment of a safety container in an open and unlocked state (FIG. 10) and in a closed and locked state (FIG. 11). Referring to FIGS. 10 and 11, the container 600 comprises container body 602 joined to a closure body 601 comprising slider 605 engaged within frame 630 between platform 612 and angle brackets 610*a* mounted on platform or landing 612. Brackets 610*a* are mounted on platform 612 by a vertical portion extending perpendicular to the outer surface of platform 612, capped with a horizontal portion that extends at a right angle from the vertical portion to overlap edges of slider 605 in the closed configuration. The angular shape of brackets 610*a* is best seen in the cross-section (FIG. 24) of similar embodiment shown in FIGS. 13, 13A and 14, in which brackets 710*a* correspond to brackets 610*a* of FIGS. 10 and 11. Platform 612 is spaced from the horizontal portions of brackets 610*a* by a distance sufficient for slider 605 to move between platform 612 and the horizontal portion of brackets 610*a* with a modest level of friction that can readily be overcome by a shearing force that can be applied by an adult. Platform 612 also defines main opening 607 in closure body 601 for accessing contents of container 600. Stops 609, which aid in preventing slider 605 from being inadvertently removed from closure portion 601, protrude from the upper surface of slider 605. As in the case on any of the embodiments described herein, stops 609 and/or frame 630 preferably are composed of a resilient material so that the stops and/or frame can be deformed by applying a force on slider 605 in excess of the force required to merely open the container, so that stops 609 can pass through slider port 604 to completely remove slider 605 from closure body 601. It should be understood that slider 605 can be reattached to the rest of the closure body 601, or attached for the first time, by inserting the slider back into slider port 604 and applying a modest force to urge stops 609 through slider port 604. Stops 609 may be permanently attached to slider 605 by means of a permanent adhesive, for example, or may be made part of the slider (e.g., by molding or 3D printing) or may be removeably attached (e.g., by means of a pressure sensitive adhesive, by screwing into the surface of slider 605, and the like).

In FIGS. 10 and 11, depressible tab 608 is in the form of a cantilevered bar that is attached to slider 605 at one end and has an opposite head 645 that extends through slider port 604 in the closed state shown in FIG. 11. As best shown in FIG. 10, slider port 604 is in the form or a stacked "pyramid" with a stepped shape that is widest where slider 605 must be displaced, a narrower portion 604*b* sized to allow the full width of tab 608 to pass through slider port 604 when tab 608 is depressed. Slider port 604 also includes another even narrower portion 604*c* immediately below blocking bar 603 that is sized to allow head 645 of tab 608 to protrude through slider port 604, even in the closed state, but is narrow enough to block shoulders 622 of tab 608 where head 645 begins. A gripping head 642, which is optional, extends off of the end of slider 605 that protrudes through slider port 604 in the closed state. Gripping head 642 can be used for pulling on slider 605 to aid in opening, if desired. Optionally, stops 609 may also be omitted, if desired.

Closure 601 preferably is a separate piece that is joined to container body 602 either removably by a snap-fit arrangement, or is permanently bonded to container body 602, e.g., by adhesive, melt bonding, and the like. Optionally, closure 601 (excluding slider 605) may be an integral part of container body 602.

Figure 13:
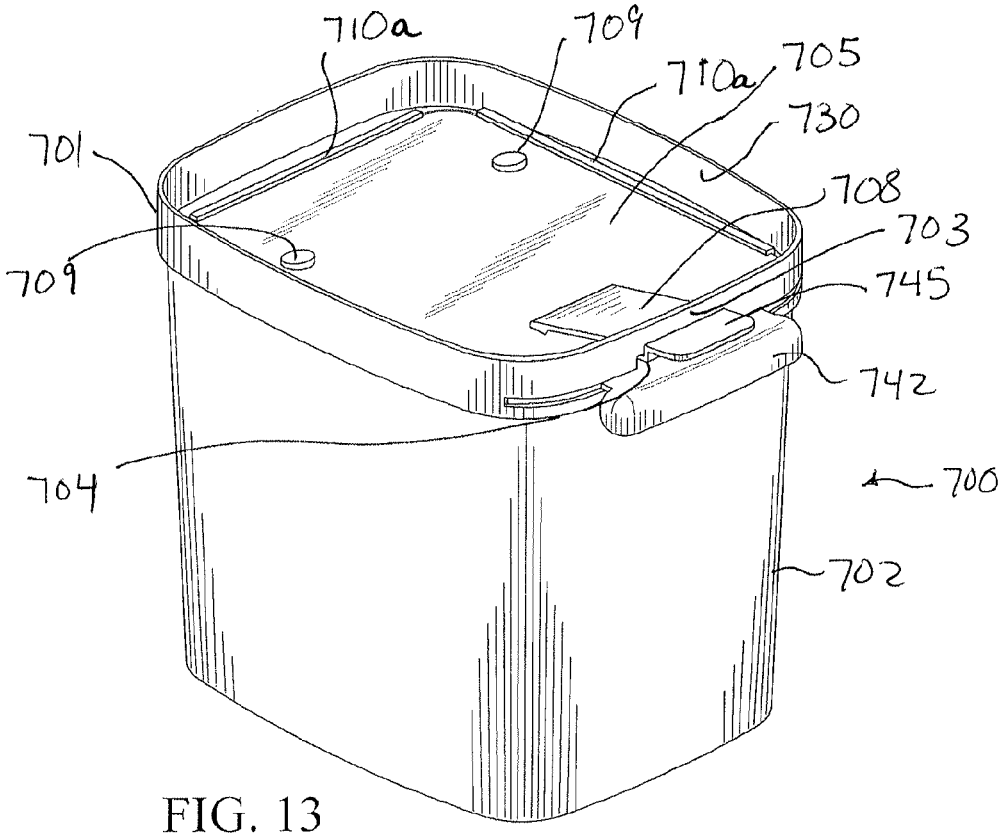
FIG. 13 shows a container including the slider of FIG. 12 in a closed configuration.
Figure 13A:
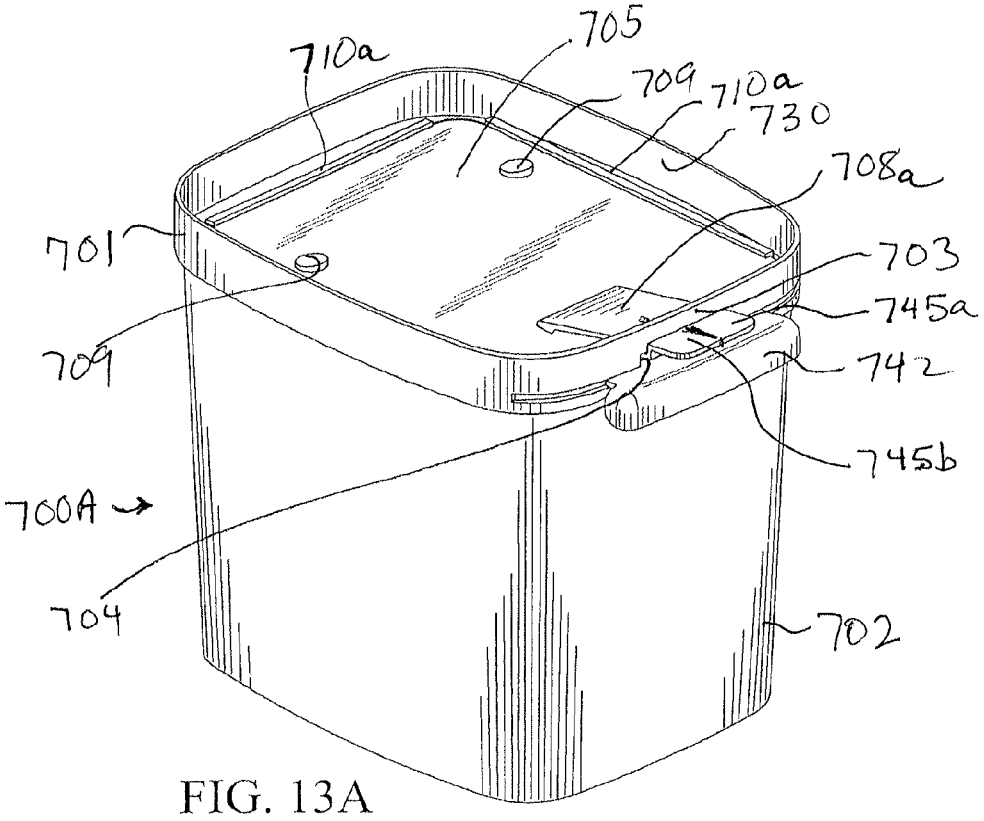
FIG. 13A shows a container including the slider of FIG. 12A in a closed configuration.
Figure 14:
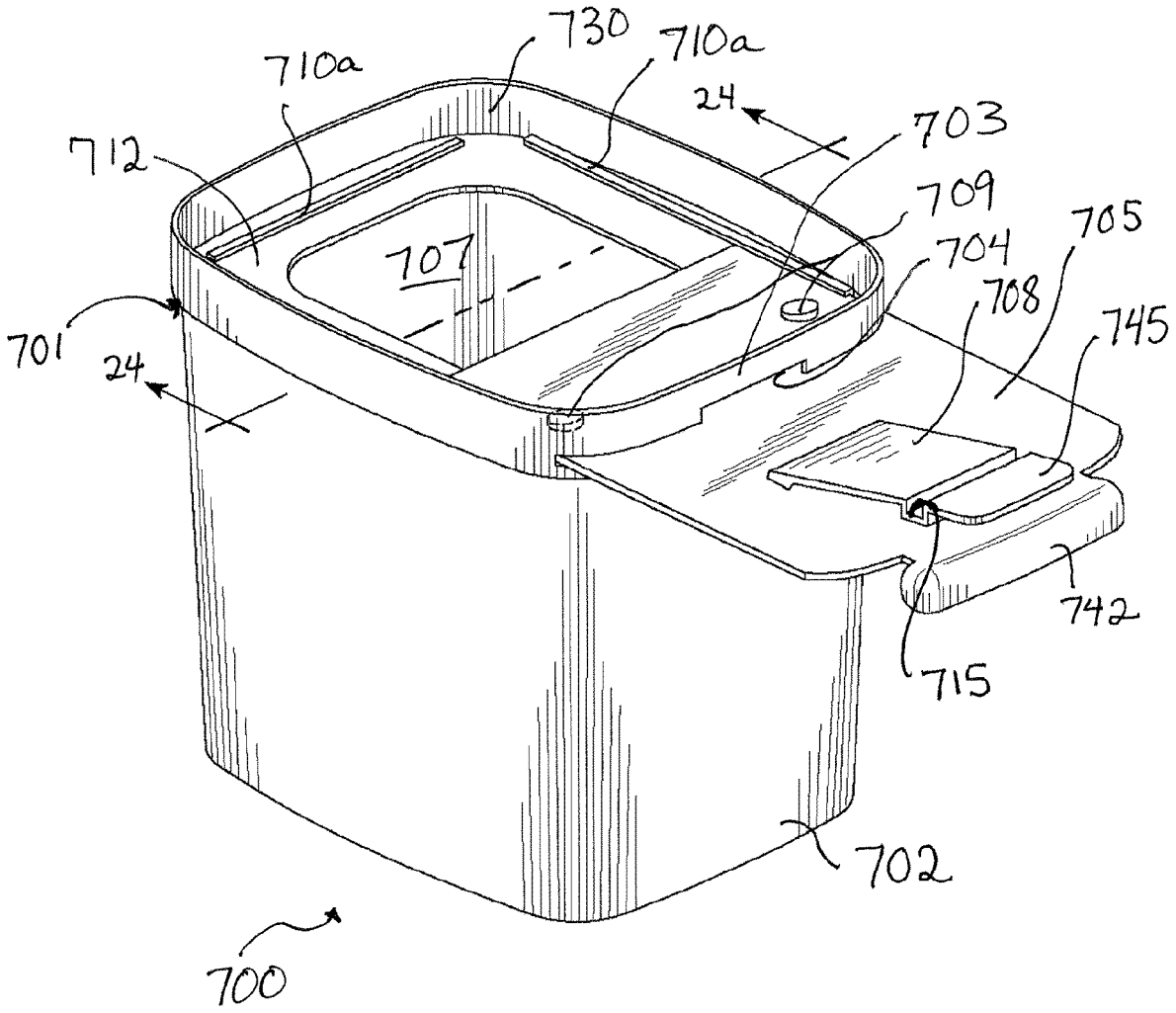
FIG. 14 shows the container of FIG. 13 in an open configuration.

FIGS. 13 and 14 shows container 700, which is similar to container 600 in FIGS. 10 and 11, and which operates in a similar matter thereto, with the exception of the certain features of slider 705 and depressible tab 708. FIG. 12 illustrates slider 705 for use with container 700. In FIGS. 12, 13, and 14, similarly numbered features correspond to the same features of FIGS. 10 and 11 (e.g., stops 709 correspond to stops 609, and the like), with differences pointed out herein. Tab 708 defines tab-engagement groove 715 arranged to engage with blocking bar 703 when slider 705 is in the closed configuration, such that head portion 745 of tab 708 is situated outside of slider port 704. The engagement of tab-engagement groove 715 with bar 703 provides another means for preventing container 700 from inadvertently being opened. In use, head 742 of slider 705 can be grasped and head 745 of tab 708 can be depressed with one hand, while container 700 is grasped or held in place by another hand, allowing the user to pull sider 705 open, if desired. Optionally, stops 709 may be omitted, if desired. Optionally, head 742 may also be omitted, if desired, or the slider head may have a different shape or configuration that the illustrated grasping handle form, but which still can facilitate opening. In any of these cases, opening and closing still involves depressing the tab, while movement of the slider may be accomplished by other means than described above.

FIG. 13A shows a container 700A, which is similar to container 700 of FIGS. 13 and 14, and FIG. 12A shows a slider similar to that of FIG. 12, but in which the head of the tab is longitudinally split in into two halves 745*a* and 745*b*. The split in tab 708*a* in FIGS. 12A and 13A extends partway into the main portion of tab 708*a*. Displacing the slider through the slider port requires both halves 745*a* and 745*b* of the head to be depressed, adding intellectual challenge to a child trying to open the container.

Figure 24:
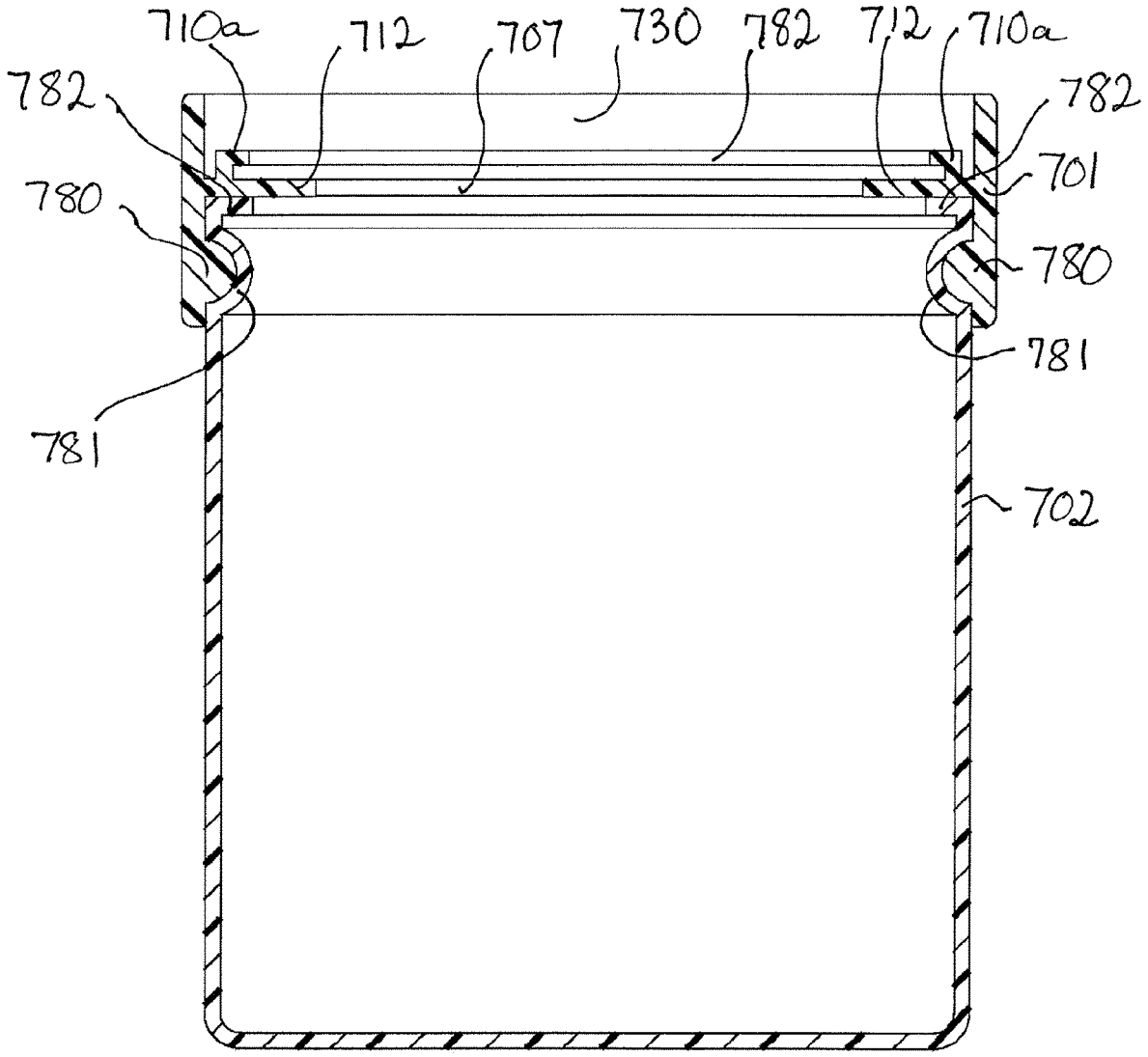
FIG. 24 illustrates a cross-sectional view of the embodiment of FIG. 14.
Figure 25:
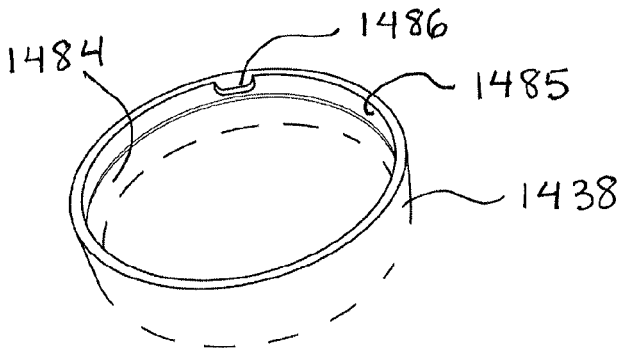
FIG. 25 illustrates a partial perspective view of a closure body base.

FIG. 24 shows a cross-section of the embodiment shown in FIG. 14 in plane 24-24 indicated in FIG. 14. As shown in FIG. 24, the closure body 701 and container body 702 are held together by a snap-fit system comprising a ridge finish 780 on the inner surface of closure body 701 interacting with a grooved finish 781 on the exterior of container body 702. Other embodiments with a grooved finish on the closure body and a ridge finish on the container body can be contemplated. A ridge and grooved finish combination is present at the same elevation on each of the four sides of the approximately cuboidal container of FIG. 14. In general, the longer the ridge and grooved finish on each side, the more force is required to attach and remove closure body 701 from container body 702.

Optionally, instead of an independent ridge and groove on each side of the cuboidal container, an uninterrupted circumferential ridge and uninterrupted groove may be employed about the perimeters of closure body 701 and container body 702, respectively, to hold the parts together. In such an embodiment, the force needed to attach and remove closure body 701 from container body 702 is, in general, even greater than for interrupted ridge and groove combinations. Ordinarily, it is desirable to make the force for attachment and removal sufficiently low so that the container body (without the closure body) can be filled and the closure body can then easily be attached at the manufacturer or filler facility (first-time attached), yet sufficiently high (e.g., difficult or practically impossible) to prevent the consumer from separating the closure body form the container body. This essentially forces the consumer access to the contents of the container through the main opening of the closure body (i.e., after retracting the slider).

Other embodiments can be contemplated where the container and closure bodies are round or cylindrical, and in such cases, there may be an uninterrupted circumferential ridge and an uninterrupted circumferential groove, or there may be multiple ridge-groove pairs spaced apart around the circumference, similar to the cuboidal embodiment described above with respect to FIGS. 14 and 24. In these round container embodiments, if it desirable that the closure and container bodies do not swivel or rotate, then some form of stopping elements can be incorporated along with the ridges and grooves to prevent rotation, as is well known in the container art.

There are many ways to control the relative difficulty or complexity in which the closure and container bodies of this invention may be joined or separated. The relative difficulty or complexity may be physical-mechanical, intellectual, or both. Consequently, elements or features can be provided which effect the relative permanence of the attachment. For contained products that are dangerous, it is a general aim to provide elements or features that make it relatively easy for the closure and container bodies to be first-time attached, in particular by machine (e.g., by the manufacturer or filler), and practically permanently attached when in the hands of the consumer during ordinary use, so as to force an adult consumer to access the contents via the main opening after retracting the slider.

As shown in FIG. 24, ridge 780 and grooved finish 781 have a complimentary rounded taper or profile. In general, increasing the interpenetration depth of ridge 780 and grooved finish 781 increases the difficulty for the consumer to separate the closure body from the container body. For some product contents it may be desirable to strategically incorporate lug features, either above or below the ridges or grooves, for example, to facilitate plying the closure body apart from the container body, or for other purposes. If desired, ridge and groove finishes may have other tapers or profiles, such as a hook-undercut complimentary pair, for example, that can be highly interlocking, thus making the parts practically permanently attached during ordinary consumer use. Alternatively, a groove finish on one body can have an elastomeric insert, such as an O-ring, for example, which may take the place of the ridge, so long as the insert contacts the side walls of the closure and container bodies with sufficient compressive force.

Materials employed for the various parts comprising FIG. 14 and any other embodiments described herein may be independently selected and vary according to a variety of needs. Preferred materials for closure bodies and container bodies for many goods are polymers such as polypropylenes, polyethylenes, polyvinyl chlorides, polystyrenes, other styrenic polymers, polyesters, and nylons, for example, in which case the closure and container bodies can be manufactured by a molding technique. Sometimes composite materials (such as textile-polymer composites and mineral reinforced polymer composites for example) are preferred for certain parts when there are certain structural reinforcement needs such as, for example, when there is a need to make the container suitable for heavy loads, or when there is a need to make the container puncture resistant. A leading cause of household pet accidental deaths, in particular, dogs, is from biting into containers containing household drug and chemical products. One way to make containers stronger in general and more bite resistant in particular is to employ strong puncture-resistant materials (such as for example, a high molecular weight polyethylene (HMWPE) textile, a para-aramid textile, or textile-polymer composites) and to employ good mechanical means for joining or assembling the various parts.

As shown in FIG. 14, side wall/frame 730 of closure body 701 preferably is oriented at an approximately right angle to platform/landing 712, and approximately parallel with the sides of container body 702, to provide the overall cuboidal shape illustrated in FIG. 14, to facilitate efficient packing or stacking of multiple units on a store shelf, and/or in transit. Alternatively, the sidewall/frame and/or the container finish can be configured to achieve a mutually compressive force to aid in maintaining a tight seal between the closure and container bodies or to resist separation of the closure and container bodies. For example, the angle between the side wall/frame and the platform/landing is acute, or so that the side wall/frame is bowed inward, or even where the side wall/frame has both an acute angle to the platform/landing, and also is bowed inward. A closure body side wall/frame having said acute angle or bowing could be employed when it is desired to create a compressive force between the ridge and groove finishes after joining the closure and container bodies, making certain that the container walls possess sufficient strength to resist the inward compression by the side wall/frame of the closure body (for example, by selecting the appropriate container wall/body material, dimensions, such as wall thickness, or use of reinforcements such as gussets and struts) in order to achieve the overall cuboidal shape shown in FIG. 14. Creating such a compressive force is desirable when one wishes to increase the difficulty of attaching or separating the parts. In embodiments where a uninterrupted circumferential ridges and grooves are present, a compressive force can provide for better sealing of the contents from exposure to the atmosphere.

Closure body 701 of FIGS. 14 and 24 is separately manufactured from container body 702, and is slipped or shimmied, with or without the slider, into place over container body 702, engaging ridge 780 with grooved finish 781, to achieve the overall cuboidal shape shown in FIGS. 14 and 24. When the closure and container body are intended to be separable, the closure body can be separated from the container body by first flexing one or more side wall of container body 702 slightly away from closure body 701 to separate ridge 780 from grooved finish 781, and then nudging the two bodies apart until they become free.

Alternatively, the embodiment of FIGS. 14 and 24 can be altered so that the angle between the side wall/frame and the platform/landing is acute, or so that the side wall/frame is bowed inward, or even where the side wall/frame has both an acute angle to the platform/landing, and also is bowed inward. A closure body side wall/frame having said acute angle or bowing could be employed when it is desired to create a compressive force between the ridge and groove finishes after joining the closure and container bodies, making certain that the container walls possess sufficient strength to resist the inward compression by the side wall/frame of the closure body (for example, by selecting the appropriate container wall/body material, dimensions, such as wall thickness, or use of reinforcements such as gussets and struts) in order to achieve the overall cuboidal shape shown in FIG. 14. Creating such a compressive force is desirable when one wishes to increase the difficulty of attaching or separating the parts. In embodiments where a uninterrupted circumferential ridges and grooves are present, a compressive force can provide for better sealing of the contents from exposure to the atmosphere.

The main opening of the closure body shown in FIG. 14 is formed or defined by the platform/landing, and optionally more than one main opening can be included, each opening having a different size and/or shape, if desired.

As shown in FIG. 24, the bottom surface of platform/landing 712 contacts a circumferential inward extension 782 surrounding the open end of container body 702. Optionally, inward extension 782 can be omitted. In the embodiment of FIGS. 14 and 24, the open end of container body 702 is larger than main opening 707 of closure body 701. Optionally, embodiments are contemplated with different closure body main openings and container body open ends, providing different, advantageous, functional features.

An inward extension, when present, can have various thicknesses and inward projecting lengths, and can be employed for advantageous purposes such as, for example, (i) providing a stop for the closure body; (ii) providing additional structural support and reinforcement of sections of the article and even the whole article; (iii) providing a surface for a compressive sealing or seating material (e.g., a liner, O-ring or gasket) between the closure body platform/landing and the inward extension surfaces; and (iv) providing a surface whereby part of, or even the entire, surface contact area between the closure body platform/landing; and the inward extension may be permanently bonded or welded to the platform or landing, for example, using glue, solvent welding, and the CLEARWELD process (TWI, Ltd.), among a variety of other bonding or welding techniques appropriate for the materials to be joined. Including a sealing or seating material, as described in (iii) above, is present, or when a bond or weld, as described in (iv) above, uninterruptedly around the perimeter or circumference of the container in the area between the closure body platform/landing and the inward extension eliminates a pathway for liquid and gas exchange between contents of the container and the atmosphere (i.e., by sealing or restricting gaps between the closure body and the container body). This contributes to overall better sealing. One preferred welding technique for sealing the closure body to the container body, when both the platform/landing and inward extension are made of polymeric materials, is RF or induction welding or sealing using a RF or induction welding or sealing film situated between the inward extension and the closure body platform/landing, which generates sufficient heat to weld the polymeric components and sealing film together when subjected to an external RF or induction welding or sealing source. This provides permanent attachment of the closure body to the container body, and contributes to excellent overall sealing. The sealing film can be an independent article that is laid onto the inward extension surface shortly before joining the bodies together, or the sealing film can be affixed or adhered to either the bottom surface of the platform/landing, the top surface of the inward extension, or both, at some earlier stage (such as at the molding or fabricating company for example), and then subsequently permanently joined by RF or induction welding or sealing means after assembly (such as at a filling company for example).

It should now be recognized that if an inward extension of the container body is not present then, if desired, the wall or landing of the closure body could accommodate a sealing or seating material as in (iii) above or be able to bond to the platform/landing of the closure body like in (iv) above.

It should now be recognized that many types of closure and container bodies can be contemplated, and they can be designed, fabricated or equipped to have various sealing, joining, separating, and space-saving properties and advantages. While the embodiment of FIGS. 14 and 24 is a type of embodiment where the inside surface of the side walls of the closure body contacts the outside surface of the container walls, there are also embodiments that can be contemplated where outside side surfaces of the closure body contacts inside side surfaces of the container walls making the closure body more plug-like (somewhat like a stopper in a bottle where the closure body would be like the inner member of the stopper and the container body would be like the outer member). These embodiments can provide a very compact article leading to highly advantageous space-savings, in particular stacking, and can also be prone to less damaged when dropped or during transit. They can also give sealing advantages. Additional stacking advantages can be contemplated for nearly all embodiments when the bottom surface of the container is constructed to have features complementing or interpenetrating with the features of, at, or near the top surface of the article.

Also, now that the embodiment of FIGS. 14 and 24 has been described, it should be readily understood that novel, advantageous, multi-compartment embodiments of this general design can be contemplated. The compartments may be vertical, i.e., separated by walls or ribs generally at right angles to the planes formed by the bottom and top surfaces of the container, or the compartments may be stacked, i.e., separated by walls or ribs generally parallel with the planes formed by the top and bottom surfaces of the container. In the case of horizontal compartments, the compartments being separated by an opening that may be optionally plugged or sealed (depending upon the particular contents and their properties) and when plugged or sealed the plug or seal is able to be removed or pierced via the main opening of the container when the slider is displaced.

The closure body shown in FIGS. 14 and 24 can be adapted to attach to a wide variety of container body forms and is particularly well suited for larger volume pails and tubs. When the contents are large, such as laundry detergent packets, for example, then a large main opening and large slider are usually preferred so that the consumer can reach into the container in order to retrieve the contents.

Figure 15:
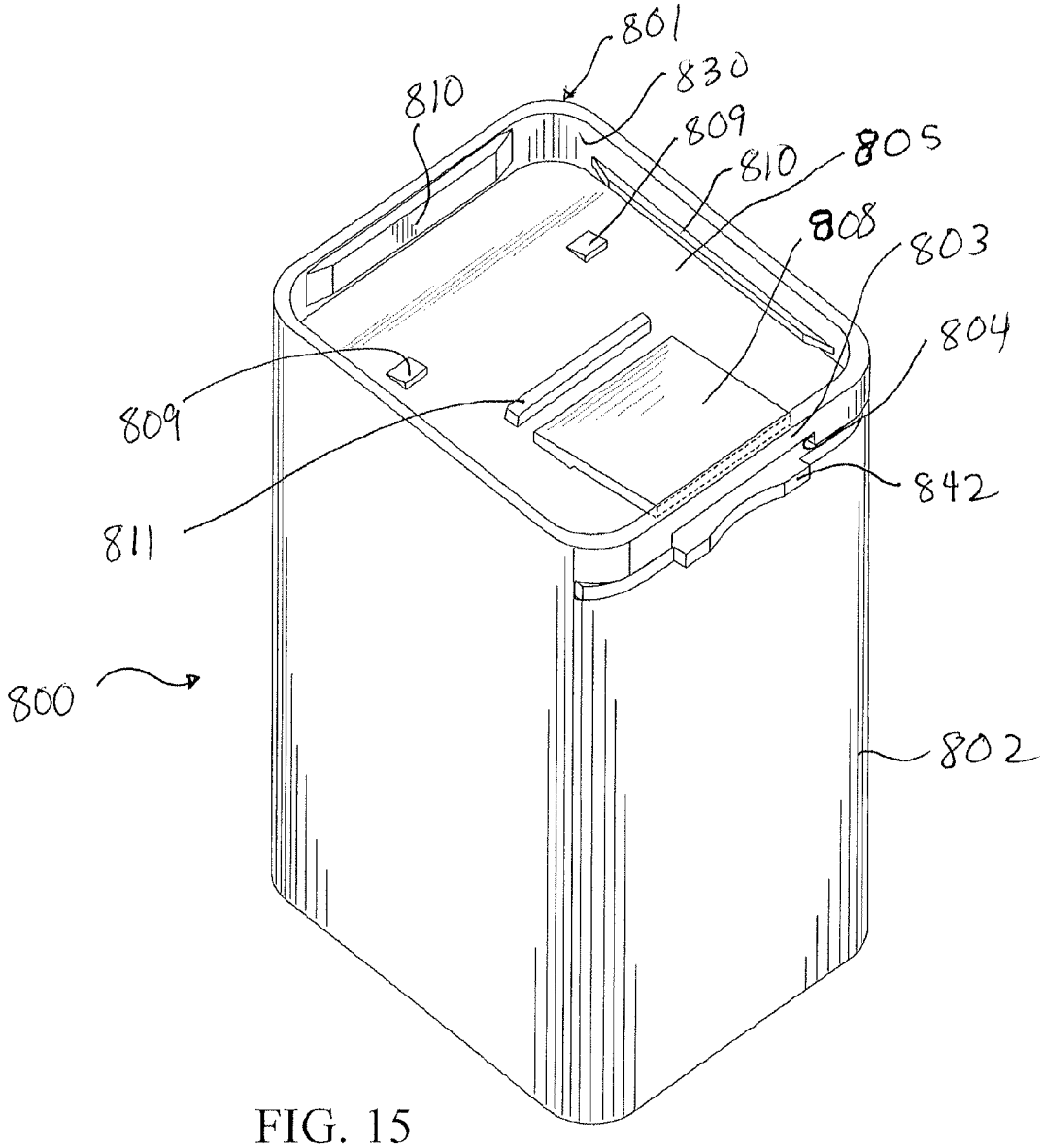
FIG. 15 shows an embodiment of a container with an integral cap portion in a closed configuration.

FIG. 15 shows a container embodiment 800 with an integrated closure body similar to that of FIGS. 1-8, but in which the depressible tab 808 is in the form of a cantilever with a free distal end that terminates just prior to slider port 804 and is blocked by blocking bar 803 in the closed configuration illustrated in the Figure. Slider 805 includes a shaped head 842 that extends through slider port 804 and has a concave curved shape to accommodate a finger to apply pressure on slider 805 to ensure that the slider is fully seated in its groove or track in the closed configuration, to aid in ensuring a tight seal between slider 805 and closure portion 801. Stops 809 serve the same function as stops 109, 209, 309, and 409 in FIGS. 1-8. Raised bar 811 can provide leverage for a digit to apply a sliding force to slider 805 to open the container while tab 808 is depressed or to retract it to the closed/locked position. Rails 810 projecting from frame 830 interact with the slider 805 to create a positive downward sealing force on the landing or ledges leading to overall better sealing.

FIGS. 16 through 18 illustrate container 1000 similar to container 800 in FIG. 15, but comprising a removable locking clip 1060 that is insertable through slider port 1004 between the upper surface of slider 1005 and the raised end of tab 1008 to prevent tab 1008 from being depressed. In FIGS. 16 through 18 features 1001, 1002, 1003, 1004, 1005, 1008, 1009, and 1010 correspond to features 801, 802, 803, 804, 805, 808, 809, and 810 in FIG. 15. Slider 1005 includes extended head 1042 on the leading edge thereof, which extends beyond slider port 1004 when slider 1005 is in the fully closed configuration. Pushing against head 1042 helps ensure that slider 1005 is fully closed. Clip 1060 is roughly fork shaped with a central portion 1061 flanked by two side-tines 1062. Tines 1062 include notches 1064 which can engage with holder pegs 1070 of clip holder 1072 on bottom surface 1006 of container body 1002 for storage of clip 1060 when not in use. In use, notches 1064 engage with sides 1019 of slider port 1004 to hold clip 1060 in place between slider 1005 and tab 1008. To remove clip 1060, tines 1062 are pinched toward each other to disengage notches 1064 from sides 1019.

Figure 19:
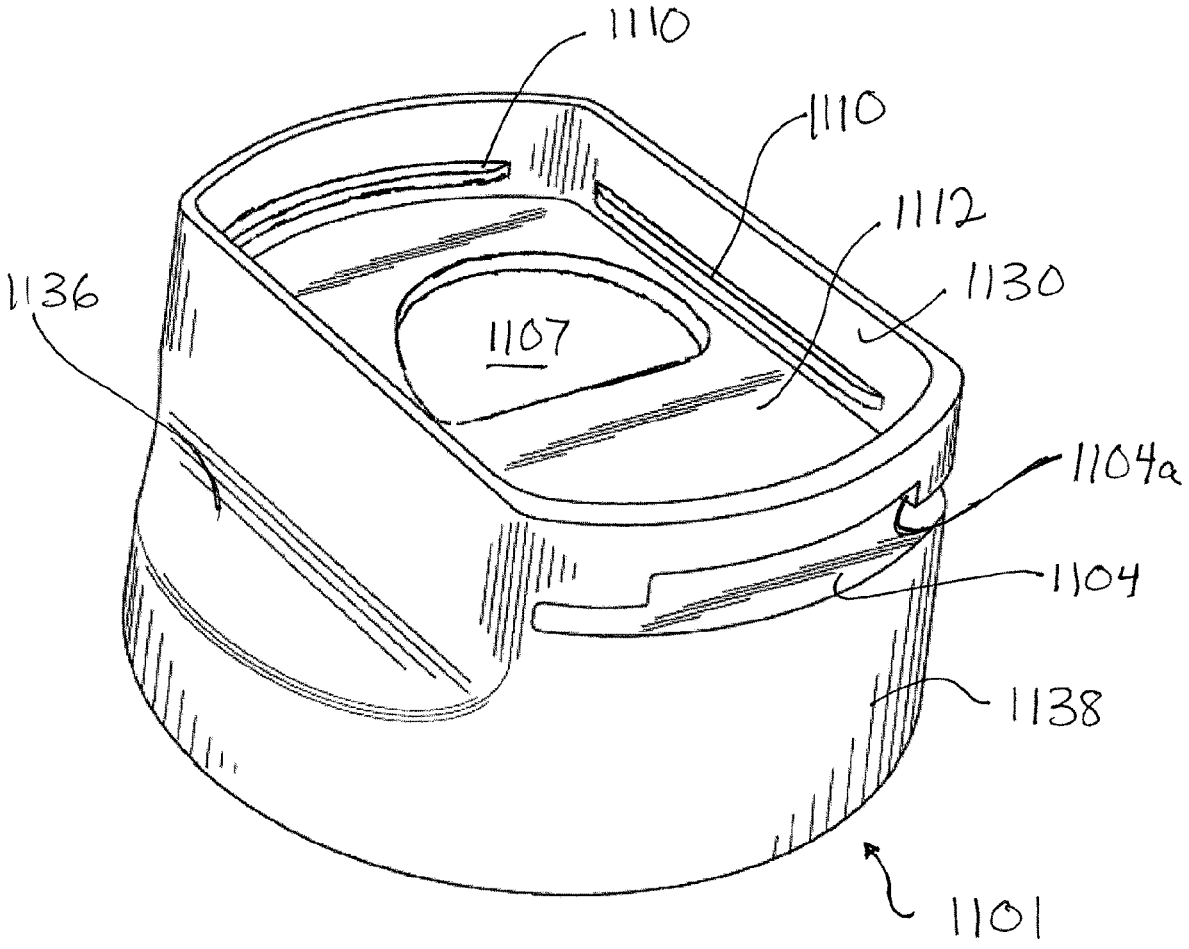
FIG. 19 illustrates a separate closure body that can be utilized with different sliders, and which is designed to be mated with a separate container body.
Figure 20:
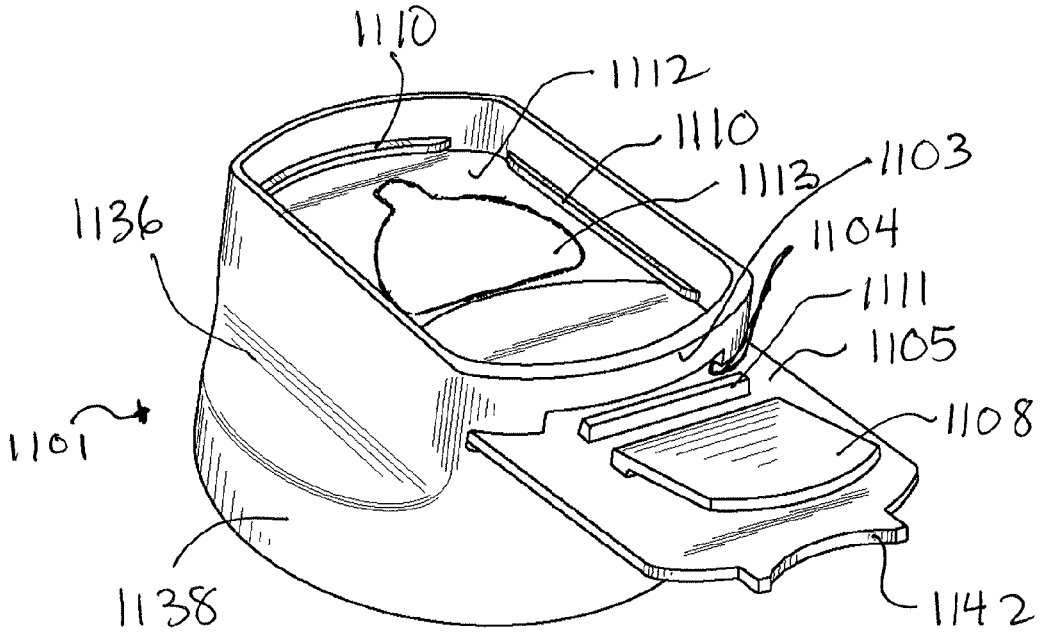
FIG. 20 illustrates a separate closure comprising the closure body of FIG. 19 fitted with a slider.

FIGS. 19 and 20 illustrates a closure 1101, which is configured as a separate cap for mating with a separate container body. FIG. 19 illustrates the closure body 1101 without a slider, and can be fitted with any form of generally flat slider described herein through slider port 1104 between landing 1112 and rails or bars 1110, with appropriate adjustment to the shape of slider port 1104, as needed, to accommodate different tab and slider configurations. Frame 1130 is illustrated in a rounded rectangular shape, but can be configured in any desired shape. Rails or bars 1110 and platform 1112 are located within frame 1130. Platform 1112 defines main opening 1107 of closure body 1101. The design of closure body 1101 shown in FIGS. 19 and 20 includes optional shoulder regions 1136 over a base region 1138. Base region 1138 would be fitted over the finish of a container body of any form (e.g., cylindrical or cubiform), when in use. Optionally, shoulder regions 1136 can be omitted or can be configured in a different shape. FIG. 20. illustrates the closure of FIG. 19 with a slider inserted. In FIGS. 19 and 20, features 1101, 1103, 1104, 1105, 1108, and 1110 correspond to features 801, 803, 804, 805, 808, and 810 in FIG. 15. Slider 1105 optionally possesses stops like the stops 809 in FIG. 15. Slider 1105 includes extended head 1142 on the leading edge thereof, which extends beyond slider port 1104 when slider 1105 is in the fully closed configuration. Pushing against head 1142 helps ensure that slider 1105 is fully closed. FIG. 20 also illustrates a removable protective seal 1113 over the main opening 1107 of the closure body 1101. In use, seal 1113 can be peeled off to expose opening 1107.

Figure 21:
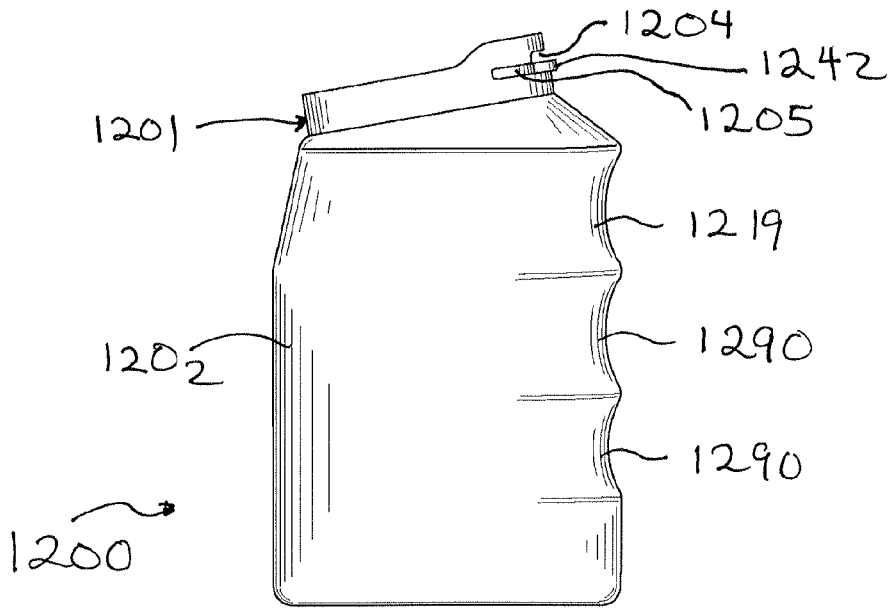
FIG. 21 illustrates an embodiment that includes a container body with finger grips.

FIG. 21 illustrates a side view of an alternative container configuration 1200, with container body 1202 mated with closure body 1201 at a slight angle to accommodate one-handed opening. A head portion 1242 of a slider 1205 protrudes out of slider port 1204. Container body 1202 includes finger grips 1290 to aid in grasping and holding the container for one-handed opening. Any of the container embodiments described herein can be adapted to include such finger grips, if desired.

Figure 22:
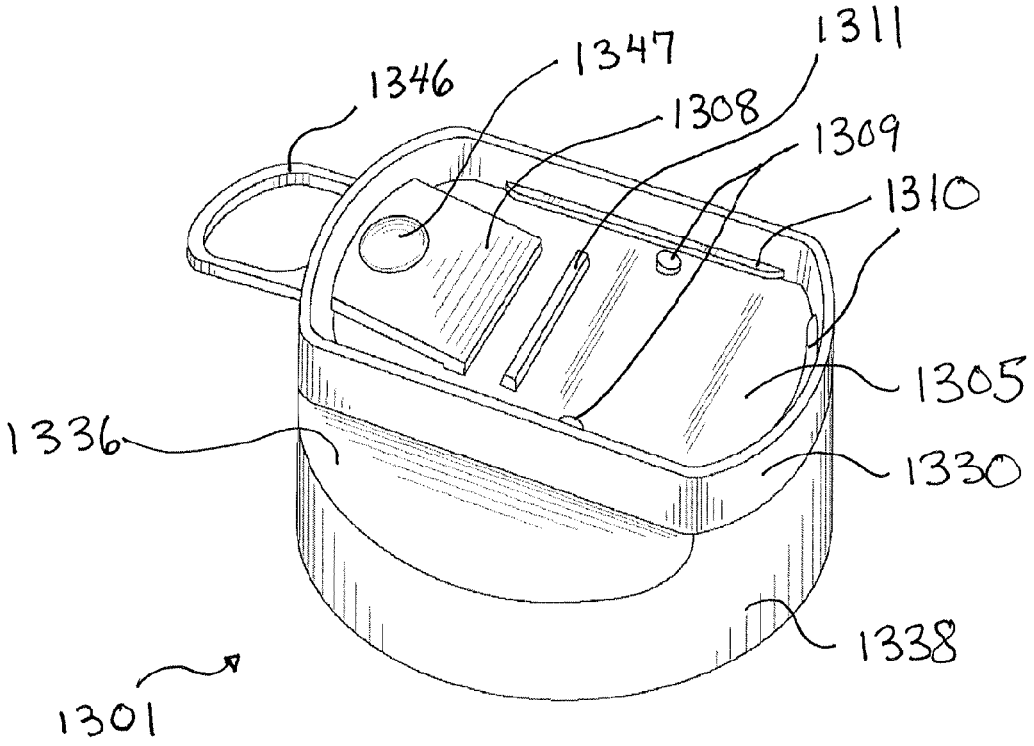
FIG. 22 illustrates a separate closure comprising a closure body similar to that of FIG. 19 fitted with a slider having a loop-shaped grasping head at the end of the slider closest to the slider port in the closed configuration.
Figure 23:
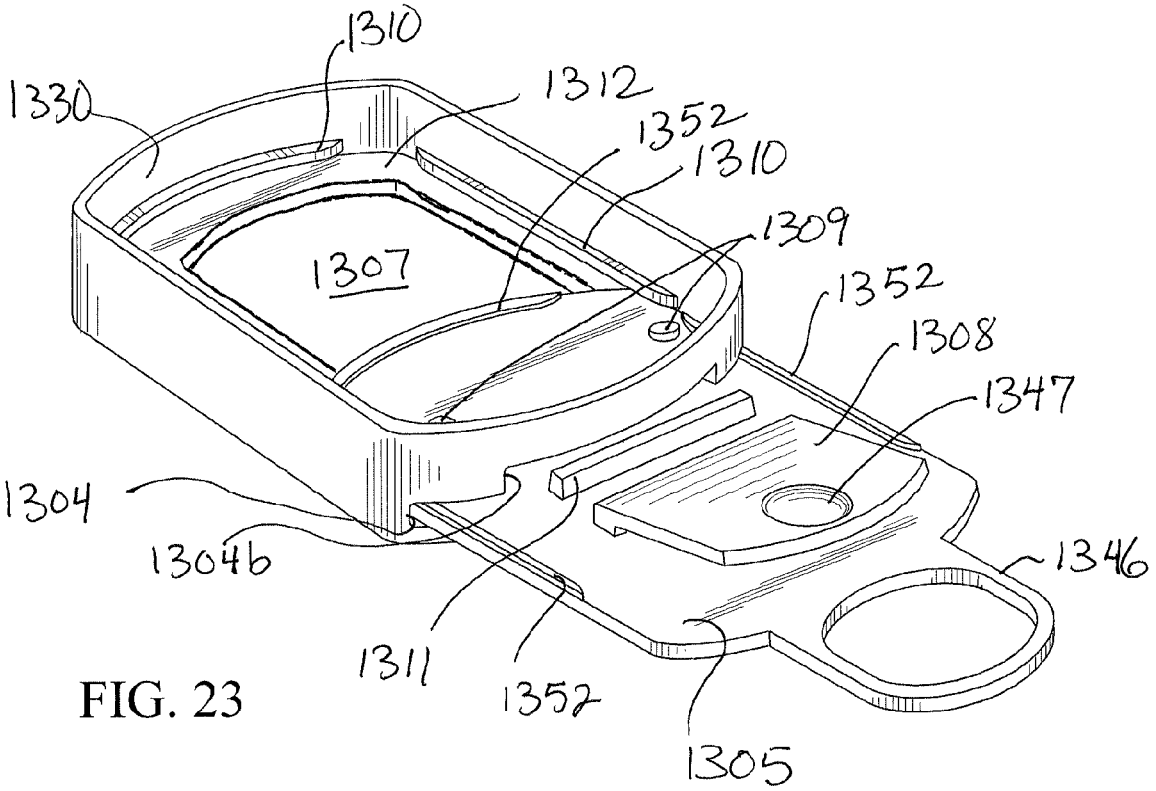
FIG. 23 illustrates a portion of the closure FIG. 22, fitted with a slider, in an open configuration.

FIG. 22 illustrates a separate closure body 1301 similar in form to closure body 1101 in FIG. 20, but in which slider 1305 includes loop-shaped head 1346 in place of the curved head 1142 of slider 1105. FIG. 23 illustrates a portion of closure body 1301 showing slider port 1304, which includes a narrower portion **1304*b* sized to allow tab 1308 pass through when depressed. Main opening 1307 in FIG. 23 is larger and shaped differently than opening 1107 in FIG. 19. Features 1304, 1307, 1310, 1311, 1330, 1336, and 1338 in FIGS. 22 and 23 correspond to features 1104, 1107, 1110, 1111, 1130, 1136, and 1138 of FIG. 20. Optional slider stops 1309 serve a similar function as stops 109 in FIG. 1. The finger of a user can be inserted through loop-shaped head 1346 to aid in pulling slider 1305 through slider port 1304 when opening. In addition, cantilevered tab 1308 includes a depression 1347 as a tactile cue for locating the optimal position for applying pressure to depress tab 1308. Loop-shaped head 1346 is illustrated in the same plane as the remainder of slider 1305; however, head 1346 optionally can be oriented at an angle to the plane of slider 1305 (e.g., a 30 degree angle, a 90 degree angle, or any other desired angle), if desired. Optionally, the closed loop or ring-like shape of head 1346** can be replaced by a partial or open loop (e.g., a semi-loop or hook shape).

FIG. 23 illustrates the upper crown portion of the closure of FIG. 22 comprising the elements encompassed within frame 1330, which can also be utilized as a separate closure itself, if desired. The crown or closure is illustrated in the open configuration, showing sealing strips/elements 1352. Rails 1310 and sealing strips/elements 1352 are configured and arranged so that strips/elements 1352 can slide under rails 1310 to apply a force on slider 1305 creating tighter contact with platform/landing/ledge 1312 in the closed position, and thus improve overall sealing. Rails 1310 may be rigid or flexible and are constructed to create a slight interference fit with the sealing strips/elements 1352 and slider 1305. It is preferred that either the rails 1310 or the sealing strips/elements 1352, or both, be flexible, as this creates compliance between the separately fabricated slider and the closure body, which leads to improved tolerance stack-up and interchangeability between these parts. It is even further preferred that rails 1310 are rigid and that sealing strips/elements 1352 are flexible. This provides both good compliance and maximizes displacement of the slider toward the platform/landing/ledge 1312, because the rigid rails are further reinforced by frame 1330. In a similar manner, if desired, sliders 605/705 of the embodiments of FIGS. 10 and 14 may also possess sealing strips or elements on the surface of the slider opposite the main opening that interact with brackets 610*a*/710*a* to produce a positive downward force on platforms/landings 612/712. It is similarly preferred that brackets 610*a*/710*a*, sealing elements on sliders 605/705, or both are flexible. It is even more preferred that brackets 610*a*/710*a* are rigid and the sealing strips or elements on sliders 605/705 are flexible.

The various closure body parts such as those shown in FIGS. 19-23 can be utilized with a wide variety of container bodies of various volumes and forms, but are particularly well suited, because of their rounded base portions (1138, 1338), for use with containers, such as bottles and jars for example, having a round mouth geometry or a cylinder-like neck geometry. While the closure and container bodies can be connected in a variety of ways (e.g., by gluing, incorporating push-on/twist-off threaded features, incorporating continuous threaded features, incorporating snap-fit features, etc.), we have discovered that child-resistant connections are particularly advantageous. This is because we have discovered that having more than one child-resistant closure feature in a single container can bring numerous advantages. For example, when closure bodies of the kinds shown in FIGS. 19-23, or any of the other novel closure bodies described herein, are connected to container bodies using another different kind of child-resistant connection, this gives consumers a choice between the two child-resistant closure types to access the contents. Having this choice makes the child-resistant container much more appealing and much more functional to adult consumers of a wider range of conditions, disabilities and impairments.

Figure 26:
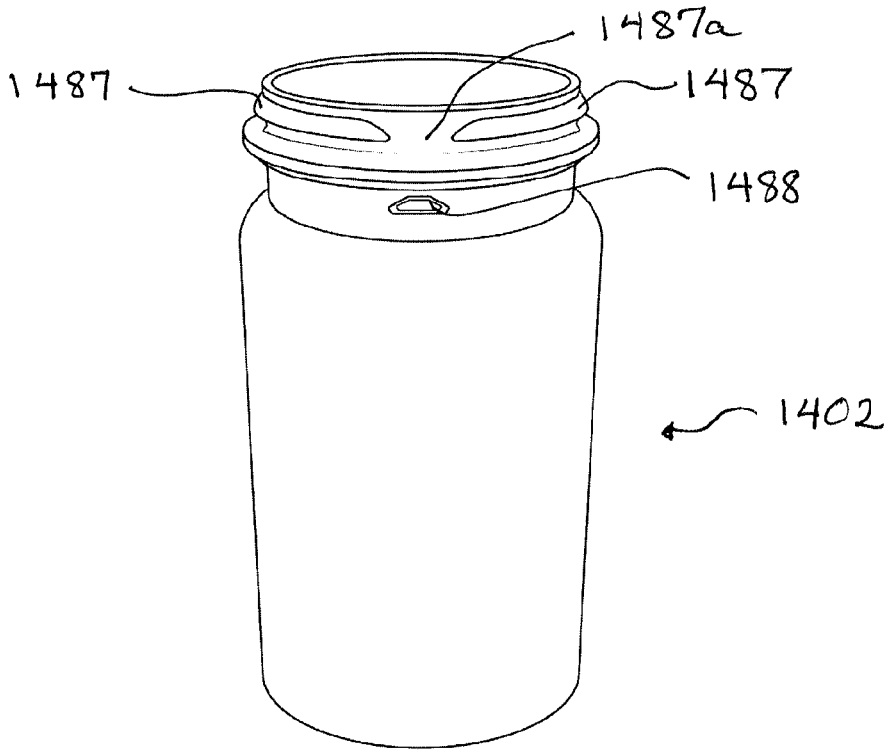
FIG. 26 illustrates a perspective view of a container body for use with the closure body base of FIG. 25.

One exemplary way of making a child-resistant snap-fit connection between closure bodies such as those of FIGS. 19-23 to bottles (i.e., container bodies) with round mouths or cylinder-like necks is to incorporate child-resistant ridge and groove features into the container and closure bodies. For example, referring to FIG. 25, which represents a partial perspective view of a closure body base 1438, corresponding to base 1138 (FIG. 20) and base 1338 of (FIG. 22), the inside wall 1484 of base 1438 possesses a continuous circumferential groove finish 1485 and a locking lug 1486, designed to mate with a bottle 1402 having a gapped ridge finish 1487 (FIG. 26), resulting in a child-resistant snap-fit closure assembly. The child-resistant feature in this snap-fit connection involves rotating the closure body so that the gap 1487*a* in ridge 1487 of bottle 1402, and the complementary-configured locking lug 1486 in the closure base 1438, which is positioned underneath the ridge 1487, so that lug 1486 is aligned with gap 1487*a* (aided by an indicator 1488 on bottle 1402 and a complementary indicator on the closure base 1438 of FIG. 25 (not shown) to indicate the correct alignment position), and the prying the closure from the bottle. Other lugs can optionally be present on the closure body to provide leverage for this prying action.

The closure body can incorporate additional structures or elements to improve or provide sealing. One example is a sealing or seating material affixed or compressed between the closure body and the landing region formed around the mouth of the bottle. Another example is a tapered, flexible ring structure encircling the main opening underneath the platform or landing of the closure body that compression fits into the mouth of the bottle.

Any of the closures shown in the attached drawing figures may constitute a separate cap for use with a separate container body, or the portion of the closure other than the slider can be an integral part of the container body or can be permanently bonded to the container body, as will be readily understood by those of ordinary skill in the art upon reading the present disclosure. Additionally, any feature present on one closure or slider shown in the drawing may be included on any other closure or slider, as desired. Additionally, the container body can take any desirable form.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The terms "consisting of" and "consists of" are to be construed as closed terms, which limit any compositions or methods to the specified components or steps, respectively, that are listed in a given claim or portion of the specification. In addition, and because of its open nature, the term "comprising" broadly encompasses compositions and methods that "consist essentially of" or "consist of" specified components or steps, in addition to compositions and methods that include other components or steps beyond those listed in the given claim or portion of the specification. Recitation of ranges of values herein are merely intended to serve as a shorthand method of referring individually to each separate value falling within the range, unless otherwise indicated herein, and each separate value is incorporated into the specification as if it were individually recited herein. All numerical values obtained by measurement (e.g., weight, concentration, physical dimensions, removal rates, flow rates, and the like) are not to be construed as absolutely precise numbers, and should be considered to encompass values within the known limits of the measurement techniques commonly used in the art, regardless of whether or not the term "about" is explicitly stated. All methods described herein can be performed in any suitable order unless otherwise indicated herein or otherwise clearly contradicted by context. The use of any and all examples, or exemplary language (e.g., "such as") provided herein, is intended merely to better illuminate certain aspects of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A closure for a container that comprises a container body defining an interior chamber, and that defines an aperture open to the interior chamber; the closure comprising:

a closure body comprising a platform defining a fixed main opening and a slider port; wherein the main opening of the closure and the container aperture are aligned to permit access to the interior chamber of the container when the closure body is attached to the container body for use; and the slider port is located in a frame that is perpendicular to and surrounding the platform;

a slider mounted in the closure body covering the platform and blocking the main opening, with a portion of the slider extending into the slide port in a closed configuration; the slider having an inner surface facing the main opening and an opposite outer surface; wherein the slider is configured to be displaceable in a direction leading through the slider port to clear the main opening, exit the closure body partially or completely in an open configuration, and to be displaceable back to the closed configuration; and at least one resilient depressible tab on the outer surface of the slider; wherein the tab comprises a resilient elongate lever fixed at one end thereof to the outer surface of the slider and having an opposed free end; the lever being oriented along the displacement direction of the slider and positioned on the slider with the free end extending beyond the slider port when the slider is in the closed configuration; the lever defining a groove that is spaced from the free end thereof, and the groove is configured and arranged to receive a blocking bar portion of the frame positioned opposite the portion of the slider within the slider port when the slider is in the closed configuration and the lever is in a released state; the lever extending over the outer surface of the slider to a height sufficient for the blocking bar portion of the frame to engage with the groove of the lever in the released state when the slider is in the closed configuration, thereby preventing the slider from moving; wherein the lever can be depressed to a height sufficient to disengage the groove of the lever from the blocking bar, so that the slider can be displaced through the slider port; and the lever rebounds to the released state when no longer depressed.

2. The closure of claim 1, further comprising at least one raised portion on the outer surface of the slider positioned and configured to allow the slider to be advanced a selected distance through the slider port and having a sufficient height from the outer surface of the slider to be blocked by the portion of the frame surrounding the slider port and prevent the slider from being wholly removed from the closure body in normal use.

3. The closure of claim 2, wherein the height of the raised portion is selectively adjustable to clear the slider port for full removal of the slider from the closure body.

4. The closure of claim 1, wherein edges of the slider ride on one or more internal tracks in the closure body.

5. The closure of claim 1, further comprising at least one removable locking clip engageable with the slider and closure body to prevent depressing the tab.

6. A container comprising:

a container body defining an interior chamber, and defining a container aperture open to the interior chamber; and a sliding closure of claim 1 affixed to the container body over the container access.

7. The container of claim 6, wherein the container body defines finger grip sections which are depressions in the container body configured to aid in grasping and holding the container.

8. The closure of claim 1, further comprising a loop-shaped grasping head at the end of the slider closest to the slider port in the closed configuration.

9. The container of claim 6, further comprising a loop-shaped grasping head at the end of the slider closest to the slider port in the closed configuration.

* * * * *